United States Patent [19]

Keen et al.

[11] 4,146,134

[45] Mar. 27, 1979

[54] COLD END FOR GLASS CONTAINER PRODUCTION LINE

[75] Inventors: Robert L. Keen, Millville; Robert E. Dunn, Vineland, both of N.J.

[73] Assignee: Electronic Inspection Machines, Inc., Millville, N.J.

[21] Appl. No.: 729,863

[22] Filed: Oct. 5, 1976

[51] Int. Cl.[2] ..... B07C 1/06; B07C 1/18

[52] U.S. Cl. ..... 209/532; 209/544; 209/698; 209/558; 209/74 R; 250/223 B; 356/240; 198/339; 198/399; 198/424

[58] Field of Search ..... 209/73, 74 R, 74 M, 209/82, 111.7 R, 75; 198/339, 399, 400, 411, 424, 433, 445, 446, 486, 491, 655, 803; 250/223 B; 356/240

[56] References Cited

U.S. PATENT DOCUMENTS

| | | | |
|---|---|---|---|
| 2,643,767 | 6/1963 | Baker | 209/111.7 T |
| 2,815,113 | 12/1957 | Henderson et al. | 198/400 |
| 3,090,478 | 5/1963 | Stanley | 198/655 X |
| 3,095,082 | 6/1963 | Allgeyer | 198/486 X |
| 3,313,409 | 4/1967 | Johnson | 209/82 X |
| 3,757,940 | 9/1973 | Damm | 209/74 M |
| 3,868,012 | 2/1975 | Kinsley | 198/399 X |

*Primary Examiner*—Joseph J. Rolla

*Attorney, Agent, or Firm*—Cushman, Darby & Cushman

[57] ABSTRACT

Newly made glass containers received on a conveyor belt in random orientation are conveyed and brushed into transversally separated columns in lying-down orientation, mouths randomly forwards and rearwards. An escapement periodically addresses the leading row of the columns and sets all the containers of this row in a mouth-upwards upright condition. These upright containers are transferred, several at a time, to individual pockets of an indexing rotary table. Typically, the table has four positions, in which the containers are respectively loaded into pockets, plug gauged, photoelectrically inspected, and unloaded. The relative position of inspection-failing containers is stored in a memory and, in connection with unloading the rotary table, these containers are culled. Apparatus for accepting and automatically packing the inspection-passing containers in boxes is preferably juxtaposed with the unloading station of the rotary table.

19 Claims, 20 Drawing Figures

COLD END FOR GLASS CONTAINER PRODUCTION LINE

BACKGROUND OF THE INVENTION

After glass bottles and similar glass containers have been made and annealed in the lehr, it is necessary to inspect, sort and organize them. Principal matters looked for in the inspection are whether the bottles have the desired symmetry, are free of defects and have the proper size and shape of mouth and neck for receiving a closure. In the sorting operation, containers which have failed to pass one of the inspections are culled from the bottles which have been found acceptable. Often bottles are made by another entity than the one which will fill them, and so in the organizing operation, the bottles are arranged in a common orientation and put in boxes for shipment and storage. Even where bottle manufacture and filling is run in tandem by the same entity or by two entities with colocated facilities, intermediate boxing or palleting of the bottles is usually necessary due to production lags between when the bottles are made and when the filling entity is ready for them. Manufactures of glass bottle manufacturing equipment include, Owens-Illinois, Emhart, Powers Manufacturing Co., Ball Corporation and Brockway Glass Co., among others.

Electronic Inspection Machines, Inc., 1001 South Delsea Drive, Millville N.J. 08332 manufactures a device for inspectiong bottles having a round transverse cross-section. The device, a Model 317 Check Master is a straight-through feed, optical/electronic inspection machine utilizing phototransistors and normally performing four checks per bottle: finish, barrel, neck and bottom. Inspection speed, depending on bottle size, ranges up to 130 per minute (260 per minute in tandem). Inspection head indexing is by worm feed and the inspection head is adjustable to inspect containers of any height, and of 1.75 to 4.0 inch diameter. The Model 317 does not process non-round e.g., square cross-section bottles, because rotation of the bottles during inspection is, in this model, achieved by contacting each bottle sidewall with a rotating friction wheel while the bottle rests on a support.

As one may well imagine, as time progresses, developments in glass bottle manufacture do result in increases in output rate. For instance, the output of the lehr of one manufacturing line may be 300 bottles per minute, or more. The manufacturing speed increase has placed stress on the conduct of cold end inspection. The flow of the work and the reliability of the inspection have become problems.

SUMMARY OF THE INVENTION

The present invention relates to ways and means for improved management of the flow of bottles coming off the cold end of a glass bottle container manufacturing line, including inspecting, sorting and organizing the bottles.

The term "bottle" is used herein in its commonly understood sense, and not in a technical, industrial way to distinguish one particular form of glass container from all others. In practice, a glass bottle has an internal cavity which is open at a mouth. Often a bottle has a bottom and sidewalls. The bottle mouth may be located at the face end of a neck of the bottle. Bottle necks vary considerably in conspicuousness — some are much slimmer than the remainder of the bottle sidewall, while others are so short and wide as to be almost nonexistent. The bottle mouth region may be provided with various ridges, grooves, lugs or the like in order to permit a stopper or other closure to be assembled in mouth-closing relation with the bottle.

In practicing the invention, newly made glass containers received on a conveyor belt in random orientation are conveyed and brushed into transversally separated columns in lying-down orientation, mouths randomly forwards and rearwards. An escapement periodically addresses the leading row of the columns and sets all the containers of this row in a mouth-upwards upright condition. These upright containers are transferred, several at a time, to individual pockets of an indexing rotary table. Typically, the table has four positions, in which the containers are respectively loaded into pockets, plug gauged, photoelectrically inspected, and unloaded. The relative position of inspection-failing containers is stored in a memory and, in connection with unloading the rotary table, these containers are culled. Apparatus for accepting and automatically packing the inspection-passing containers in boxes is preferably juxtaposed with the unloading station of the rotary table.

The machine of the invention can be used with square bottles, round ones, and even with ones with unstable bottoms, with but minor modifications to the machine.

The principles of the invention will be further discussed with reference to the drawings wherein preferred embodiments are shown. The specifics illustrated in the drawings are intended to exemplify, rather than limit, aspects of the invention as defined in the claims.

BRIEF DESCRIPTION OF THE DRAWINGS

In the drawings

FIGS. 12–18 are fragmentary vertical sectional views of the packing station and illustrate successive steps in packing the bottles in cartons.

DETAILED DESCRIPTION OF THE PRESENTLY PREFERRED EMBODIMENT

Figure 1:
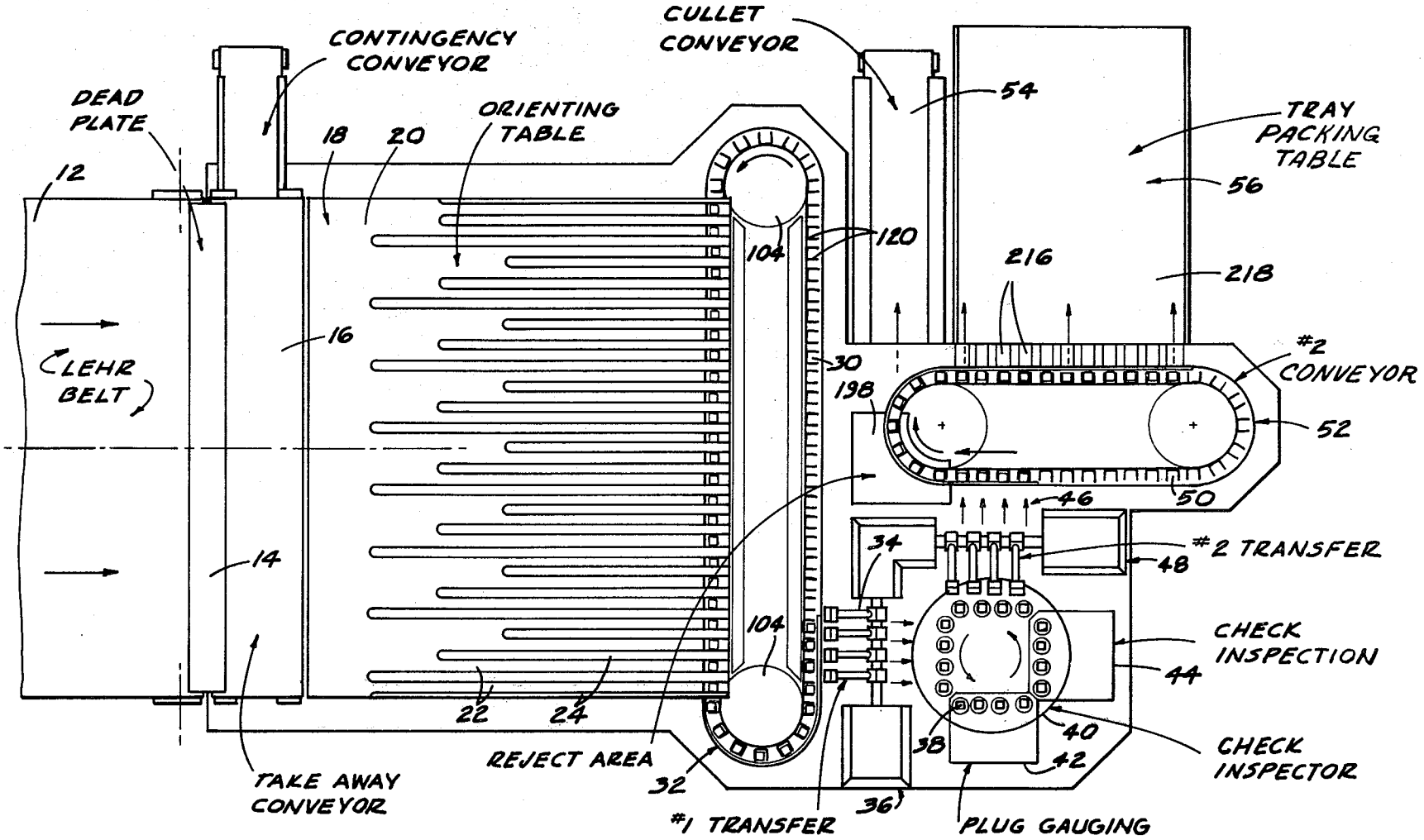
FIG. 1 is a top plan view of a glass container production line cold end provided in accordance with the principles of the invention. The remainder of the production line is conventional and unseen, to the left of this figure.

A study of FIG. 1 will provide a general overview of the roles performed by the apparatus.

The apparatus 10 is positioned at the cold end of a lehr (not shown). A lehr belt 12 conveys the bottles from the lehr to the apparatus 10 via a small dead plate 14 onto a take away conveyor 16 which moves the bottles to the first orientation table 18.

The orientation table 18, which is per se known, includes a substantially horizontal conveying surface 20 whose downstream end region is separated into a plurality of longitudinally extending, transversally adjacent lanes 22 by corresponding dividers 24. An oscillating brush 26 is moved over the surface in a sense to lay down all standing bottles and sweep them toward and into the lanes 22. The lanes 22 are only slightly wider than the bottles, so each bottle to enter a lane becomes longitudinally aligned with those ahead in the same lane, horizontal and having its neck presented either forwards or rearwards.

The combination of brushing and conveying serves to agitate the bottles, free them and move them towards the downstream ends of the lanes.

A transversally extending row of escapement devices 28 is provided at the downstream ends of the lanes 22, one escapement device for each lane 22.

The escapement devices load the bottles neck-end-up into the respective cells 30 of the upstream run of a transversally extending first indexing conveyor 32. As the bottle-loaded cells 30 reach the downstream run of the conveyor 32, they pass a transfer station 34 where a transfer device 36 transfers the bottles from the cells 30 to corresponding cells 38 of a rotary, indexing inspection table 40.

The table 40 is confronted by four stations: the aforementioned transfer-to station 34, a plug gauging station 42, an optical check inspection station 44, and a transfer-from station 46. The bottles are indexed past these stations in the order just outlined. At the transfer-form station 46, the bottles are transferred by a second transfer device 48 (which is like the device 36) from the cells 38 of the rotary table 40 to the corresponding cells 50 of a second indexing endless conveyor 52.

As the inspected bottles are indexed along by the conveyor 52, they pass a rejection station where those bottles which did not pass inspection are chuted to a cullet conveyor 54. The bottles which pass inspection continue around to the outer run of the conveyor 52 where they are unloaded at a packing station 56.

Figure 2:
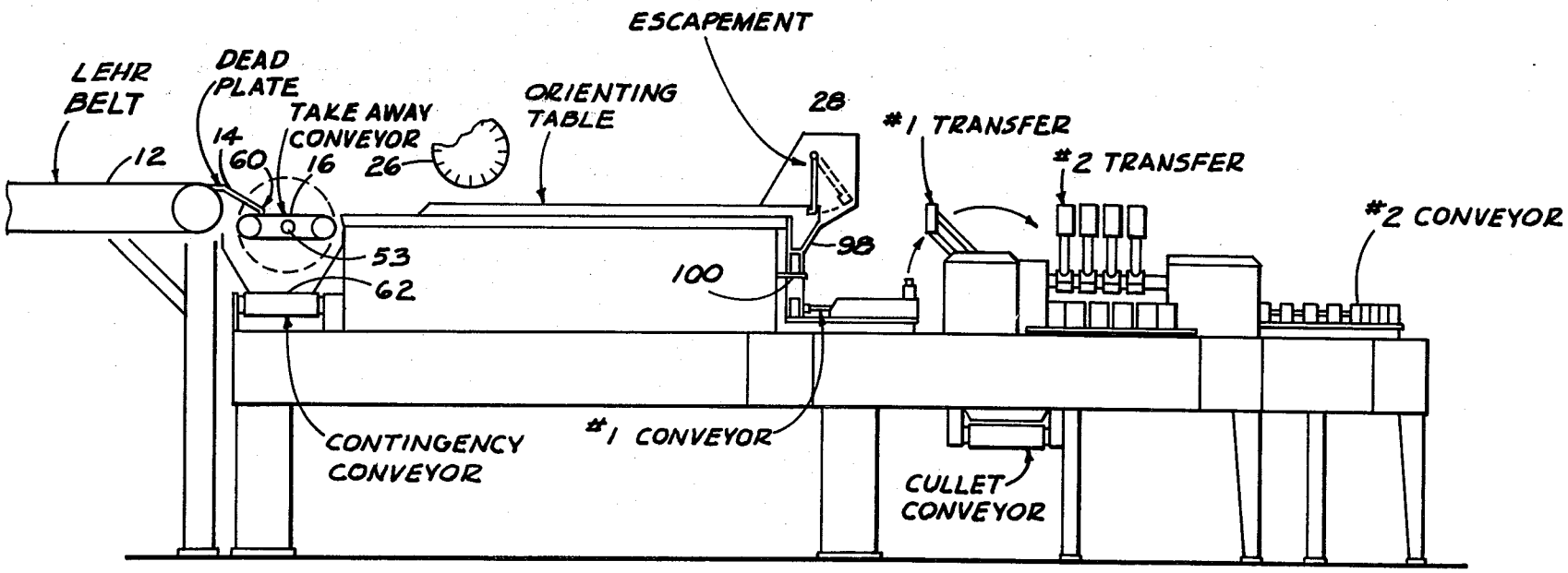
FIG. 2 is a side elevation view of the same cold end.

Much of what is shown in plan in FIG. 1 is shown in elevation in FIG. 2.

In FIG. 2, one can also see that the whole take away conveyor 16, is pivotally mounted on a horizontal axis 58 for pivoting through 90 degrees to permit all the bottles passing over the dead plate 14 to drop through the slot 60 thus created and onto the upper run of an endless contingency conveyor 62. This optional mode of operation is put into effect irregularly, e.g., when it is evident that all or substantially all the bottles coming over the dead plate are malformed, or when there is a temporary jam of bottles on the orienting table 18.

Figure 18:
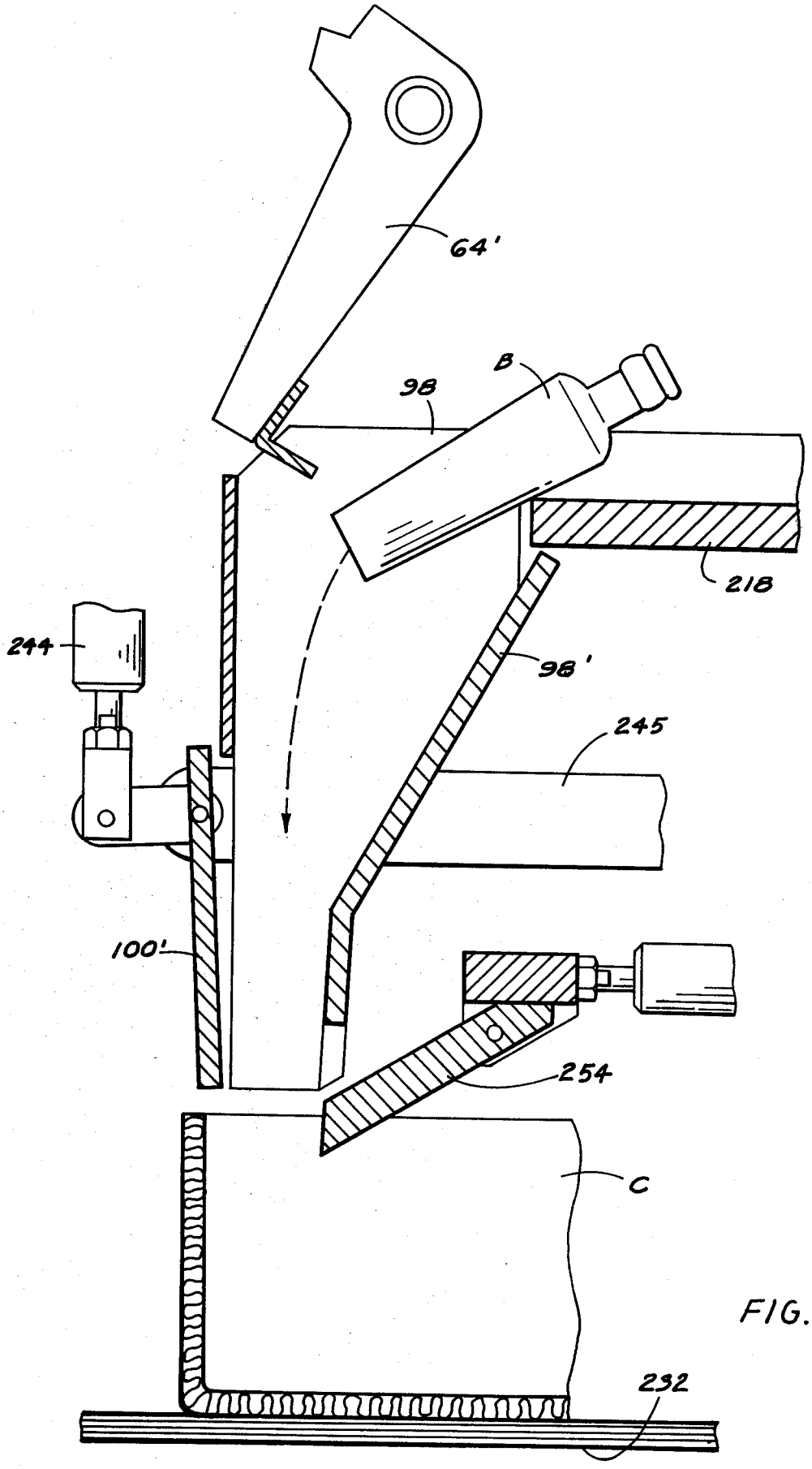
Figure 19:
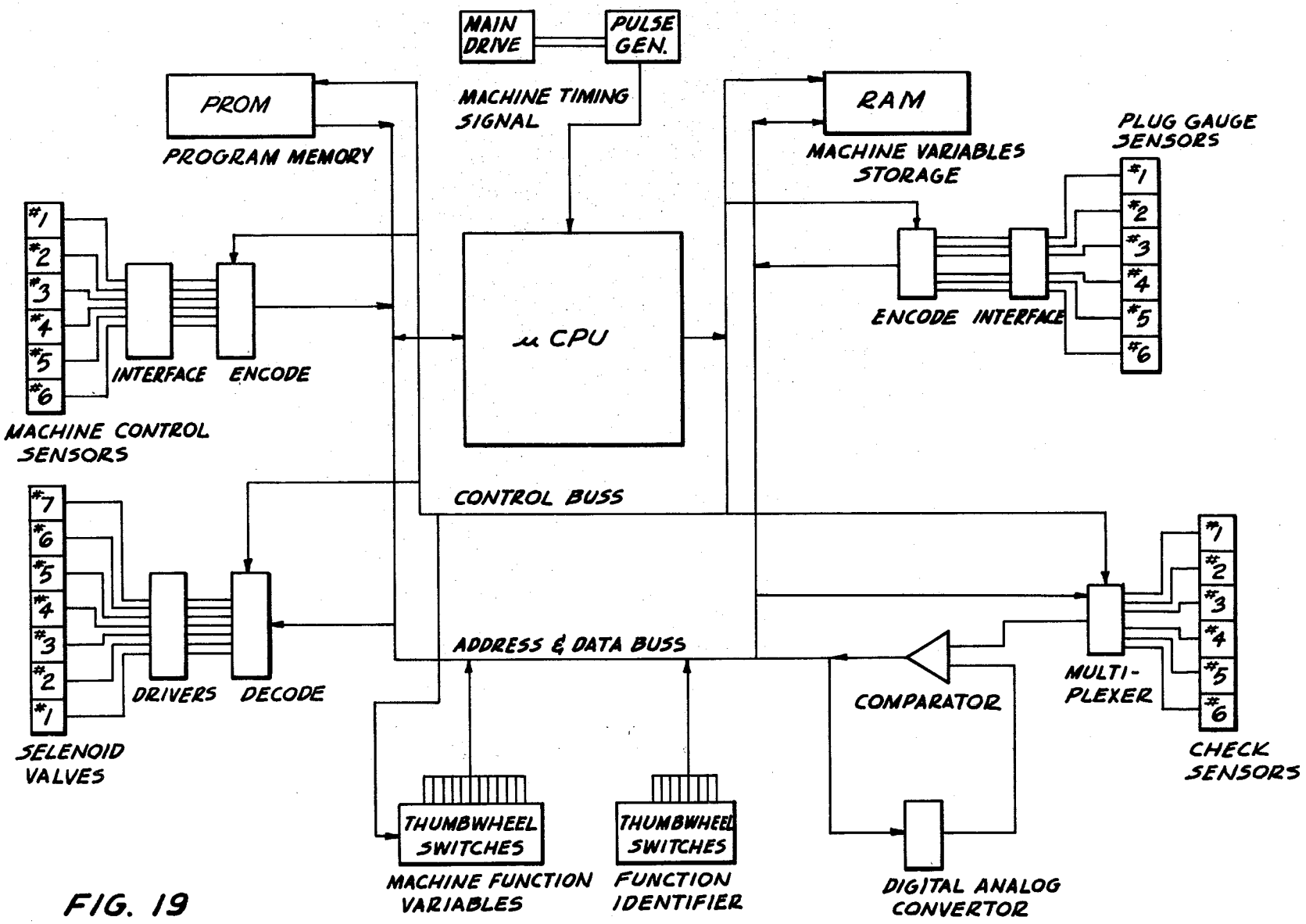
FIG. 19 is a typical schematic wiring diagram for the machine of the invention.
Figure 20:
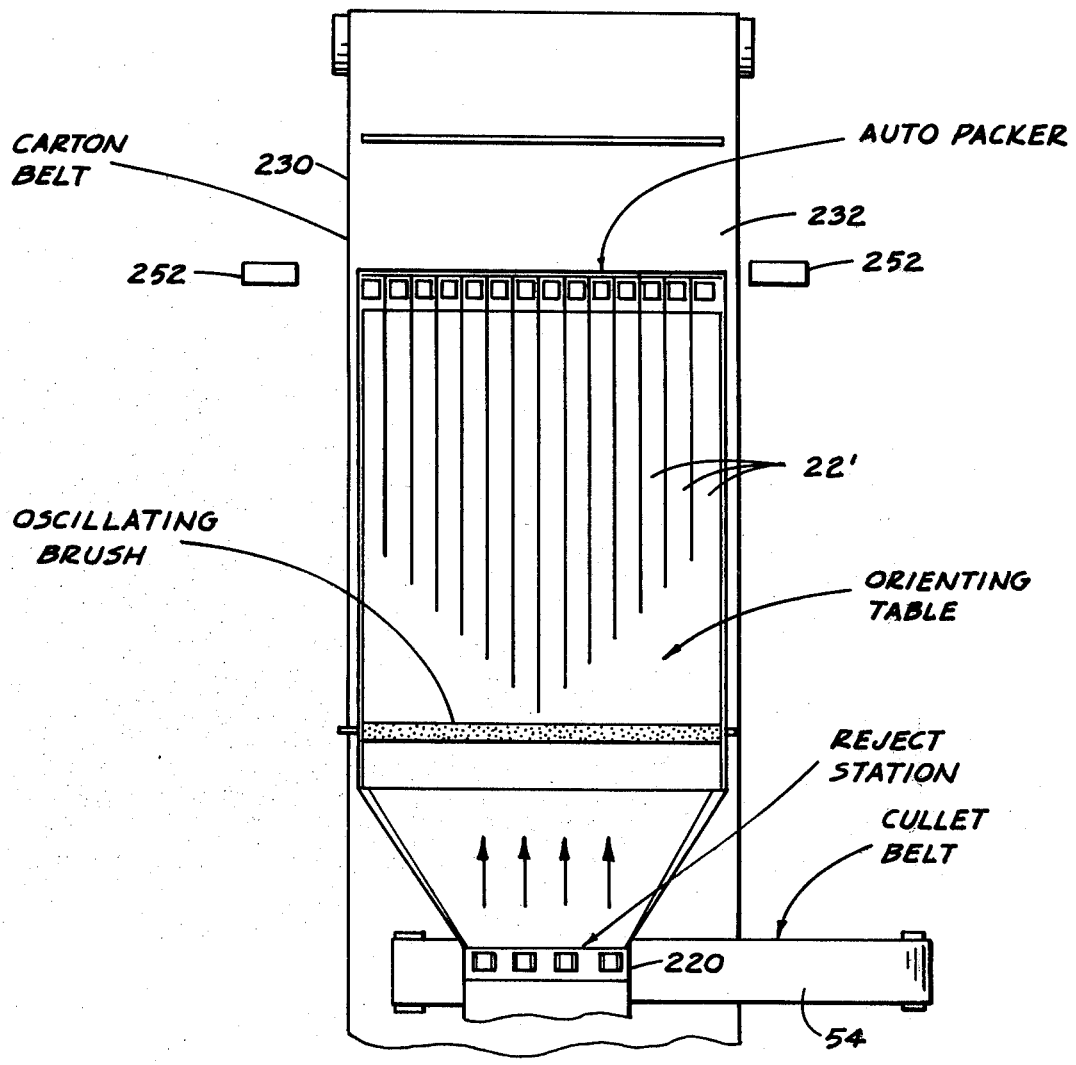
FIG. 20 is a fragmentary top plan view of an alternate form of packing station.

The succeeding FIGS. 3–18 show portions of the apparatus of FIGS. 1 and 2 in more detail. FIG. 19 shows a typical electrical control system for the apparatus, schematically. FIG. 20 shows an alternate layout for the packing station.

Additional details will now be described with reference to FIGS. 3–20.

Figure 3:
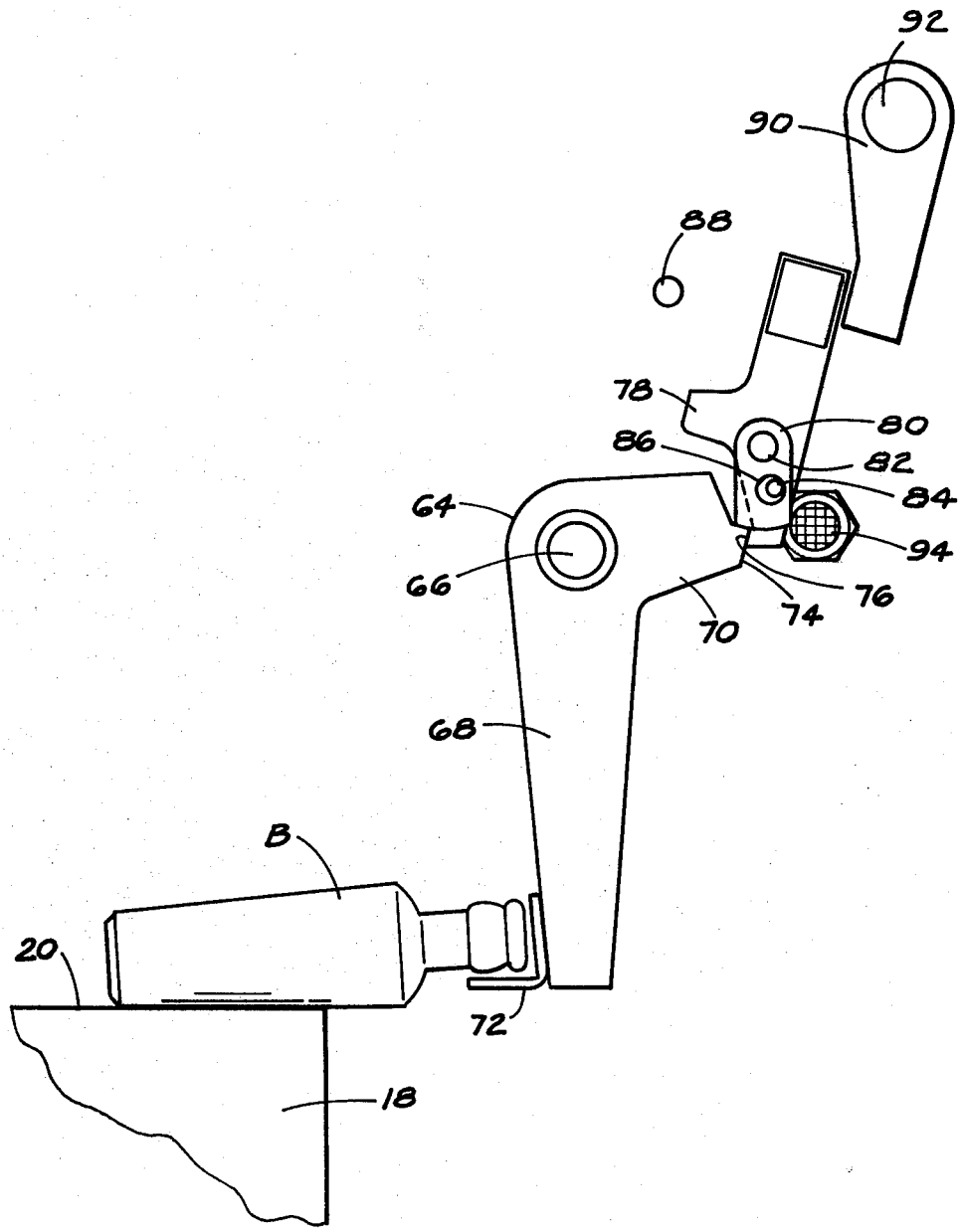
FIGS. 3, 4 and 5 are fragmentary elevation views of three successive steps in the operation of an escapement for placing bottles, bottom ends down, in respective pockets of a conveyor. In these views, the bottle illustrated has contacted the escapement mechanism mouth-forwards.
Figure 4:
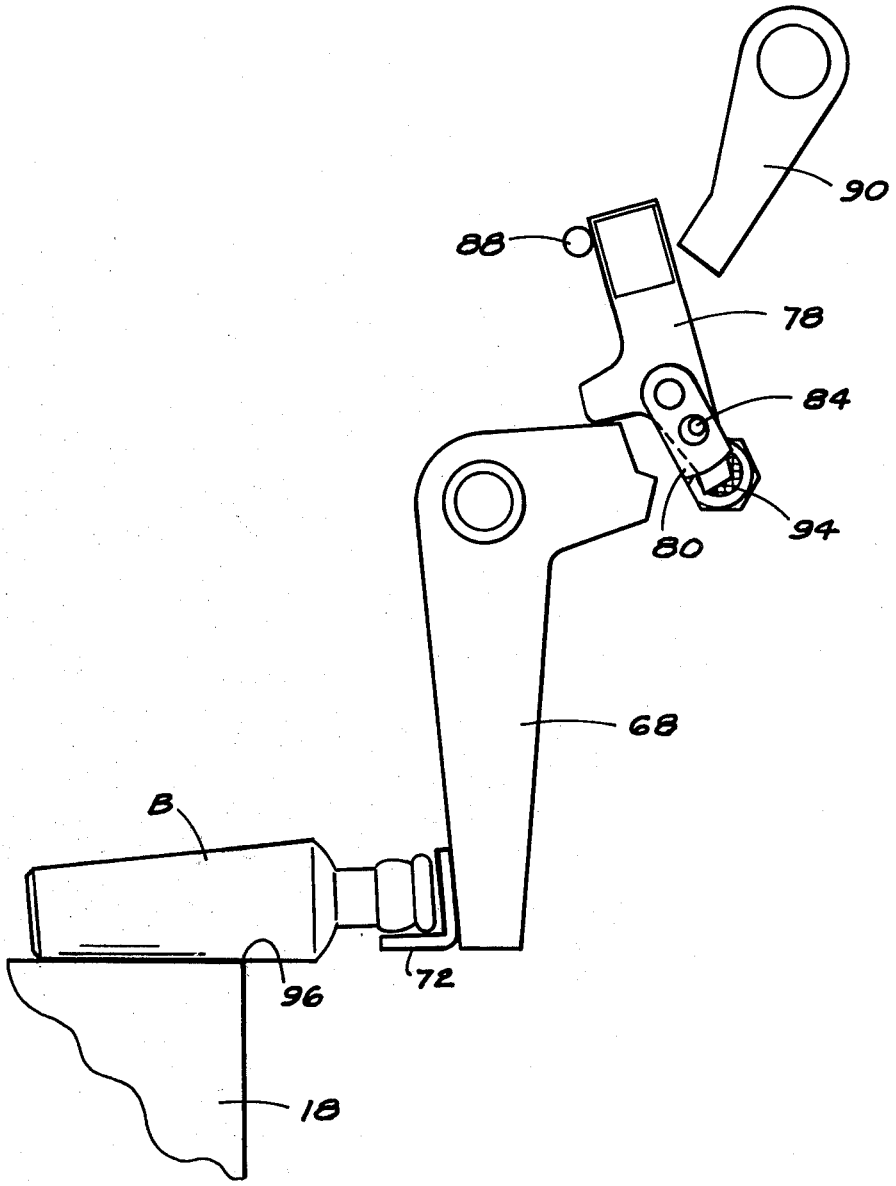
Figure 5:
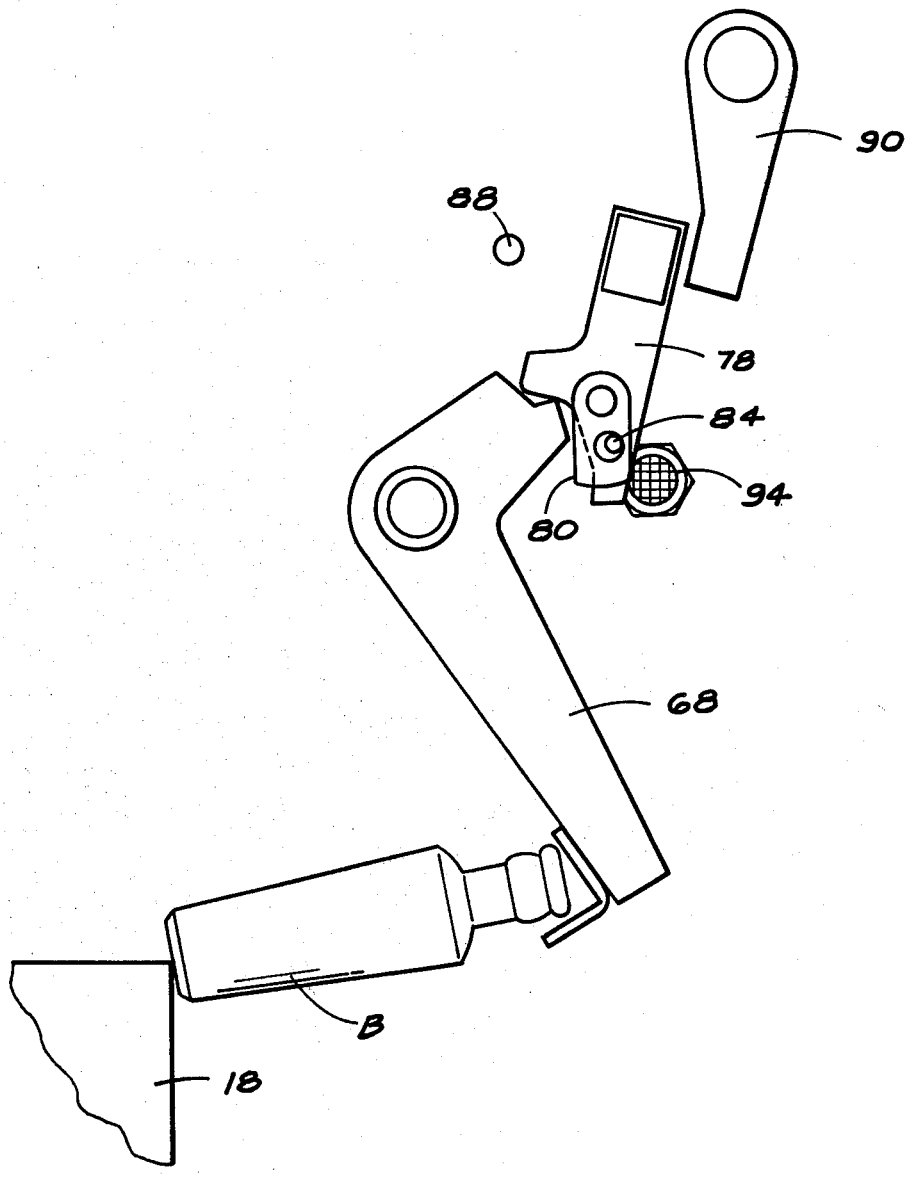
Figure 16:
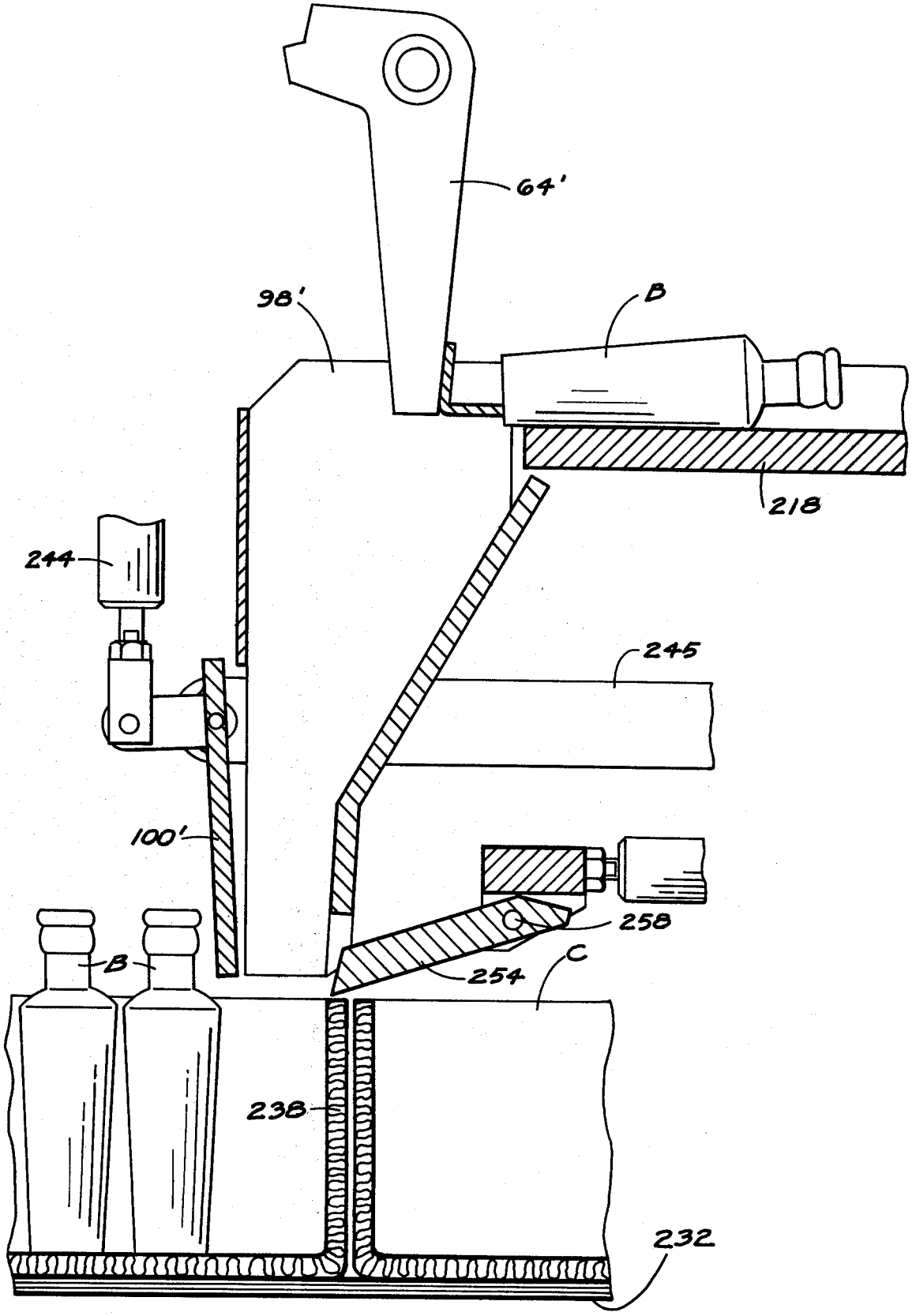
FIGS. 16 through 18 show a like escapement mechanism at a downstream station of the cold end and show operation of the escapement when a bottle has contacted the escapement mechanism bottom forwards.
Figure 17:
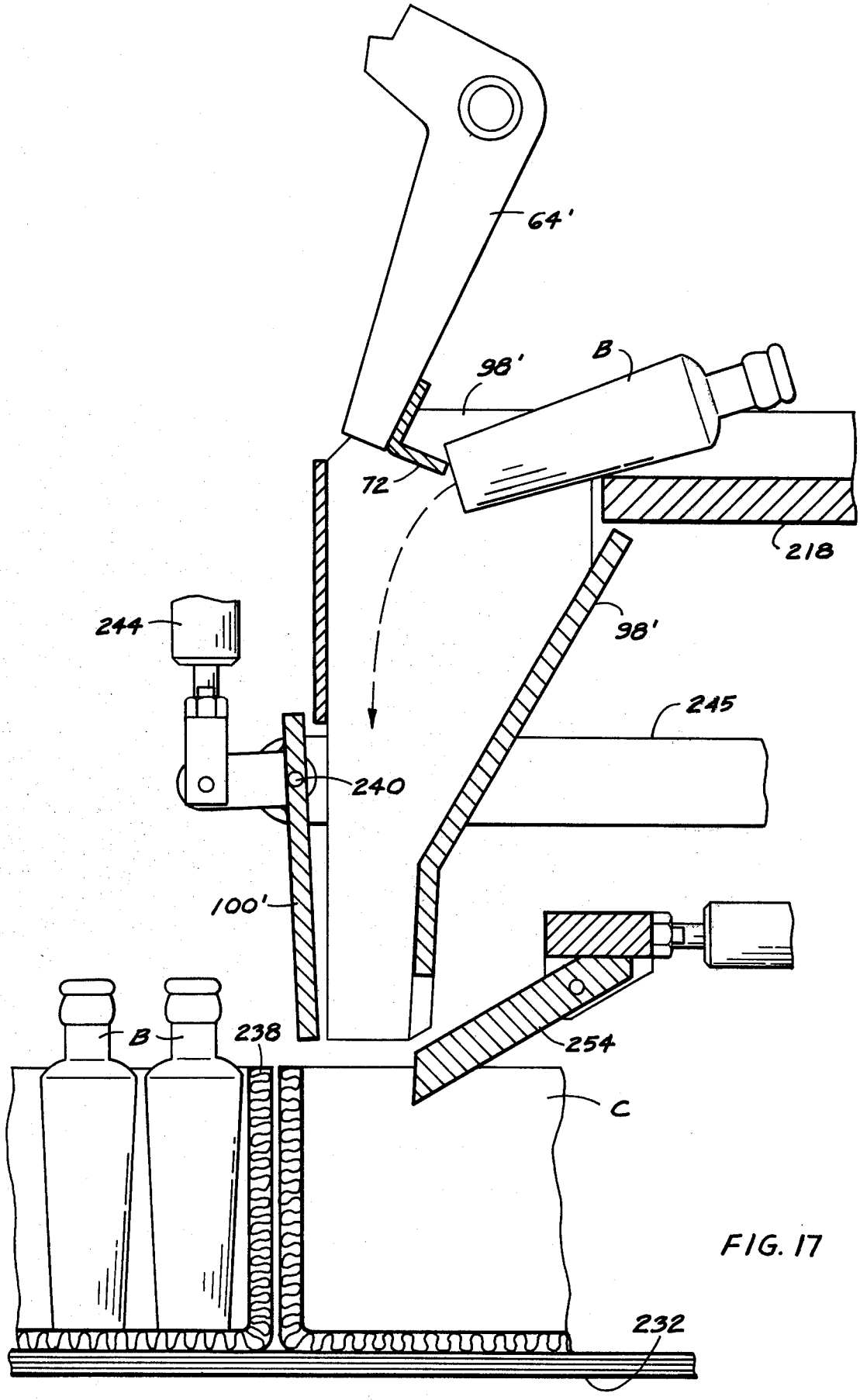

The function of the escapement devices 28 shown in FIGS. 1–5 is to accept the leading bottle in each lane 22, whether it is presented neck first or bottom first and drop it into a respective underlying cell 30 in a bottom down, neck up vertical orientation. In FIGS. 3–5, a typical sequence is illustrated for a bottle presented neck first. (A similar device in use at a later stage is depicted in FIGS. 16–18 orienting a bottle that was presented bottom first. The way a device 28 of FIGS. 3–5 would operate upon a bottle presented bottom first can be understood by referring to FIGS. 16–18.)

FIG. 3 shows the container holding and orientation lever 64 in a locked condition holding a bottle B on the surface 20 of the orientation table 18. The lever 64 is mounted on a horizontal transversally extending pivot 66 and includes a generally downwardly projecting arm 68 and a generally forwardly projecting arm 70.

The arm 68 is shown including a rearwardly projecting generally upwardly facing ledge flange 72 positioned to support the neck of the leading bottle B.

In FIG. 3, the lever 64 is not free to move about the pivot 66 because the surface 74 at the forward end of the arm 70 is engaging the rear surface 76 of an escapement lock lever 78 and is prevented from overriding the surface 76 by an anti-overriding latch 80 that is horizontally transversally pivoted to the lever 78 at 82. The pivotability of the latch 80 is restricted by a travel restriction pin 84 on the escapement lock lever 78 that projects into a somewhat oversize hole 86 in the latch 80.

Pivotability of the lever 78 about the pivot 66 is restricted in one angular sense by a fixed stop rod 88 which is engaged by the lever 78 when the lever pivots from its FIG. 3 position to its FIG. 4 position.

In the opposite angular sense, pivotability of the lever 78 about the pivot 66 is restricted by a recycle lever 90 that is pivotally mounted at 92.

A photocell detector unit 94 is stationed beside each escapement lock lever 78 to be crossed by that lever 78 when a bottle is being dropped into a chute 98 (FIG. 2). This signals the control system (FIG. 19) that this particular escapement device 28 has dropped one bottle B into the underlying chute 98 (FIG. 2) and that this particular escapement device 28 should be prevented by the recycle lever 90 from dropping another bottle until after all the escapement devices 28 have performed the same task of dropping one bottle into the respective underlying chute 98 onto the support slide 100 (FIG. 2), the slide 100 has been slid temporarily out of the way by an air cylinder (not shown, but see FIGS. 8–10 and the related description below of a similar slide and cylinder) allowing the bottles to drop, one each, into the underlying cells 30 of the first indexing conveyor 32 and the conveyor 32 (FIGS. 1, 2, 6 and 11) has then indexed forwards, e.g., twenty-four cells to bring a whole new set of empty cells 30 beneath the respective e.g. twenty-four escapement devices 28.

(FIG. 19 depicts in schematic form, a typical electronic control system for the apparatus of the invention. Its principle elements and functions are labelled on the Figure.)

In FIG. 4, the recycle lever 90 has been pivoted forwards, unlocking the escapement lock lever 78 from the container holding and orienting lever 64. The bottle B, being pushed forwards by those behind it on the orientation table 18 rests its neck on the ledge flange 72 and pivots the lever 64 arm 68 forwards (compare FIGS. 4 and 5) until the bottle B bottom clears the leading edge 96 of the table 18 and the bottle drops down a guiding chute 98 and eventually into a respective cell 30.

In FIG. 5, the recycle lever 92 has returned to its FIG. 3 position so that as soon as the bottle B is dropped, the escapement lever 64 will pivot back to its FIG. 3 position and become relatched as shown in FIG. 3.

In short, the apparatus of FIGS. 3–5 keeps running through a cycle concluded as a bottle drops (FIG. 5) and begun as a next bottle contacts the locked lever 64 (FIG. 3) and the control system (FIG. 19) operates the recycle lever 92 to permit the lever 28 to pivot again (FIG. 4).

The signal to unlock the escapement devices (i.e., to progress from the FIG. 3 situation to the FIG. 4 situation is given by the slide 100 (FIG. 2) pulling temporarily out from under the discharge chutes 98.

Figure 6:
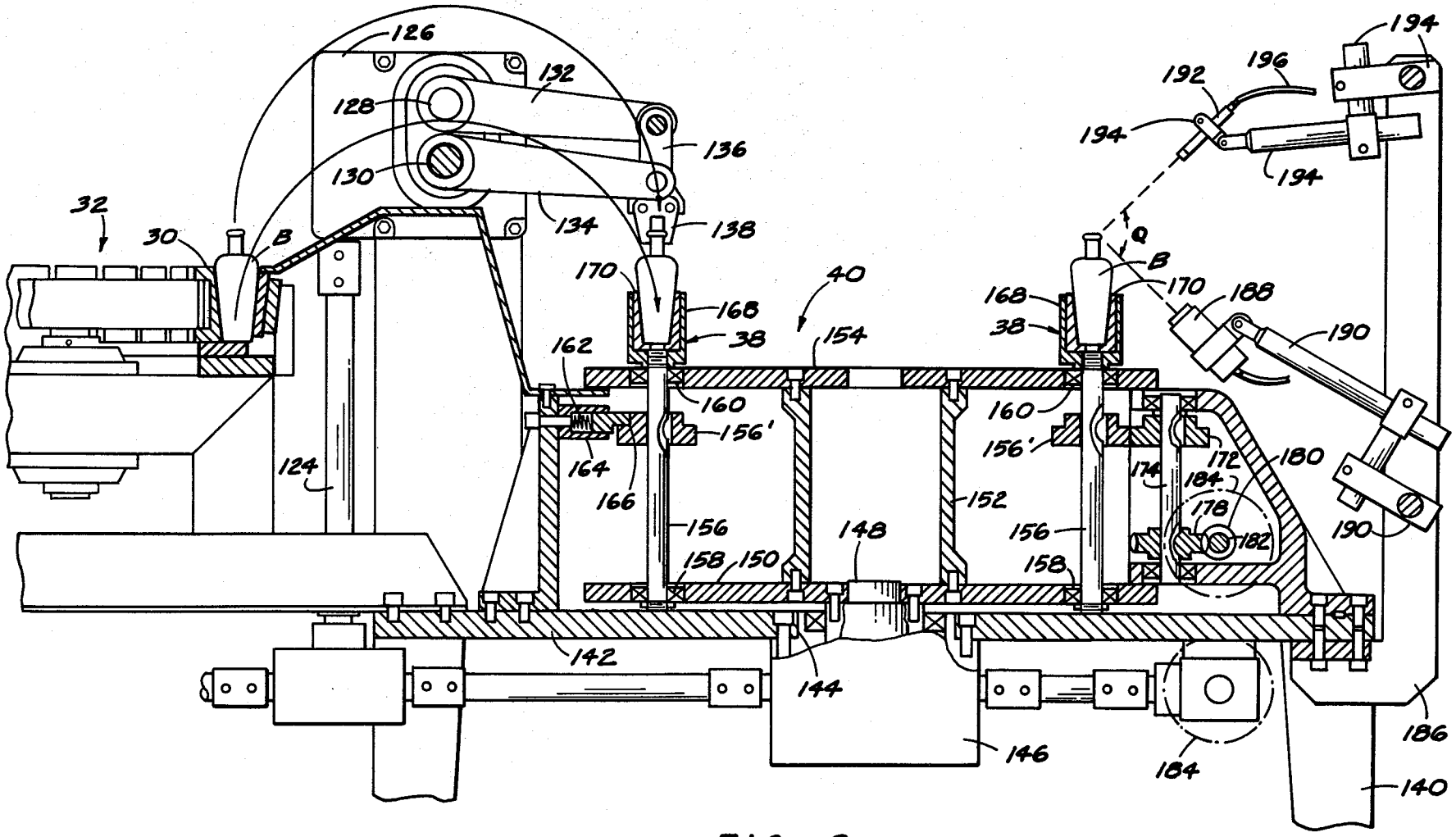
FIG. 6 is a longitudinal sectional view taken substantially on line 6—6 of FIG. 1.
Figure 7:
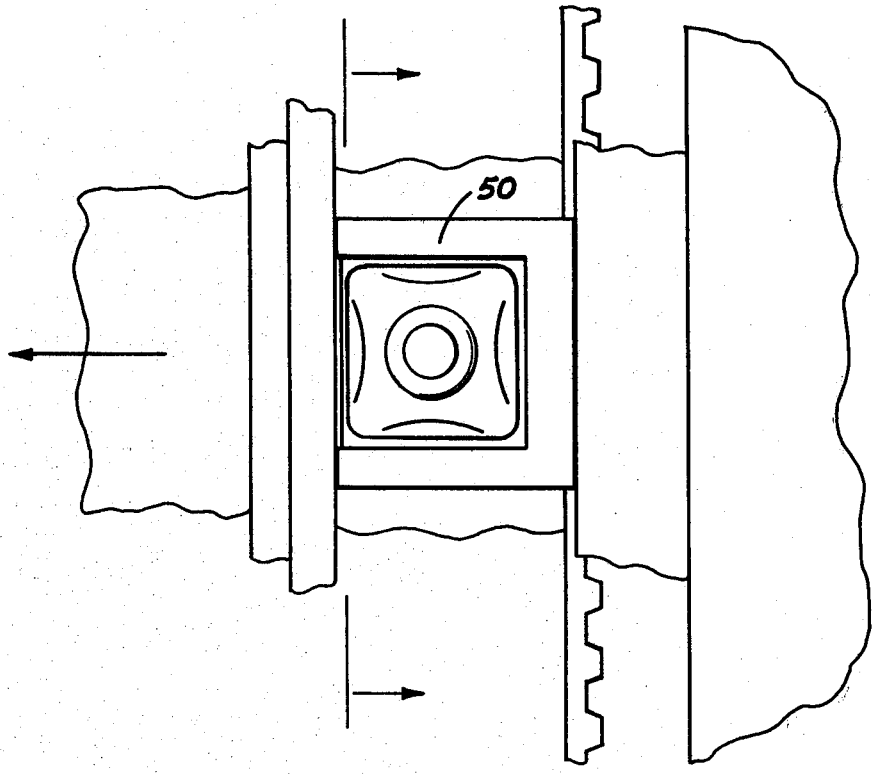
FIG. 7 is a top plan view of a bottle at the rejection station.

The conveyor 32 in the embodiment shown indexes four cells forwards each move. During each rest period between indexes, four succeeding bottle-filled cells 30 are emptied by the transfer device 36 (FIGS. 1, 2 and 6). Accordingly, the conveyor 32 must index forwards six times before a full set of twenty-four empty cells 30 is positioned beneath the twenty-four respective escapement devices 28 and the by-now-filled twenty-four respective chutes 98 are ready to drop their bottles upon temporary withdrawal of the slide 100.

The conveyor 32 is shown in FIGS. 1, 2, 6 and 11. Some of its details show best in FIGS. 1 and 11. In general, the conveyor 32 includes an endless belt 102 entrained about two transversally spaced sprockets 104, one of which is rotated by a drive shaft 106 via a drive coupling 108. The frame 110 of the conveyor 32 includes a supporting track 112 which provides a floor for the cells 30 and for the belt 102. The frame 110 further includes an upper cell guide 114, an inner belt guide bracket 116 and a lower cell guide 118 which backup the belt 102.

The belt 102 is provided with a plurality of pairs of generally vertical, outwardly projecting wall members 120 e.g. which are fin-like. Each cell 30 is defined between a respective pair of wall members 120, the belt 102 between those wall members 120, the supporting track 112 and another part of the frame 110 — an outer container guide 122 in the form of an upstanding wall circuiting the outside of the track 112.

Figure 11:
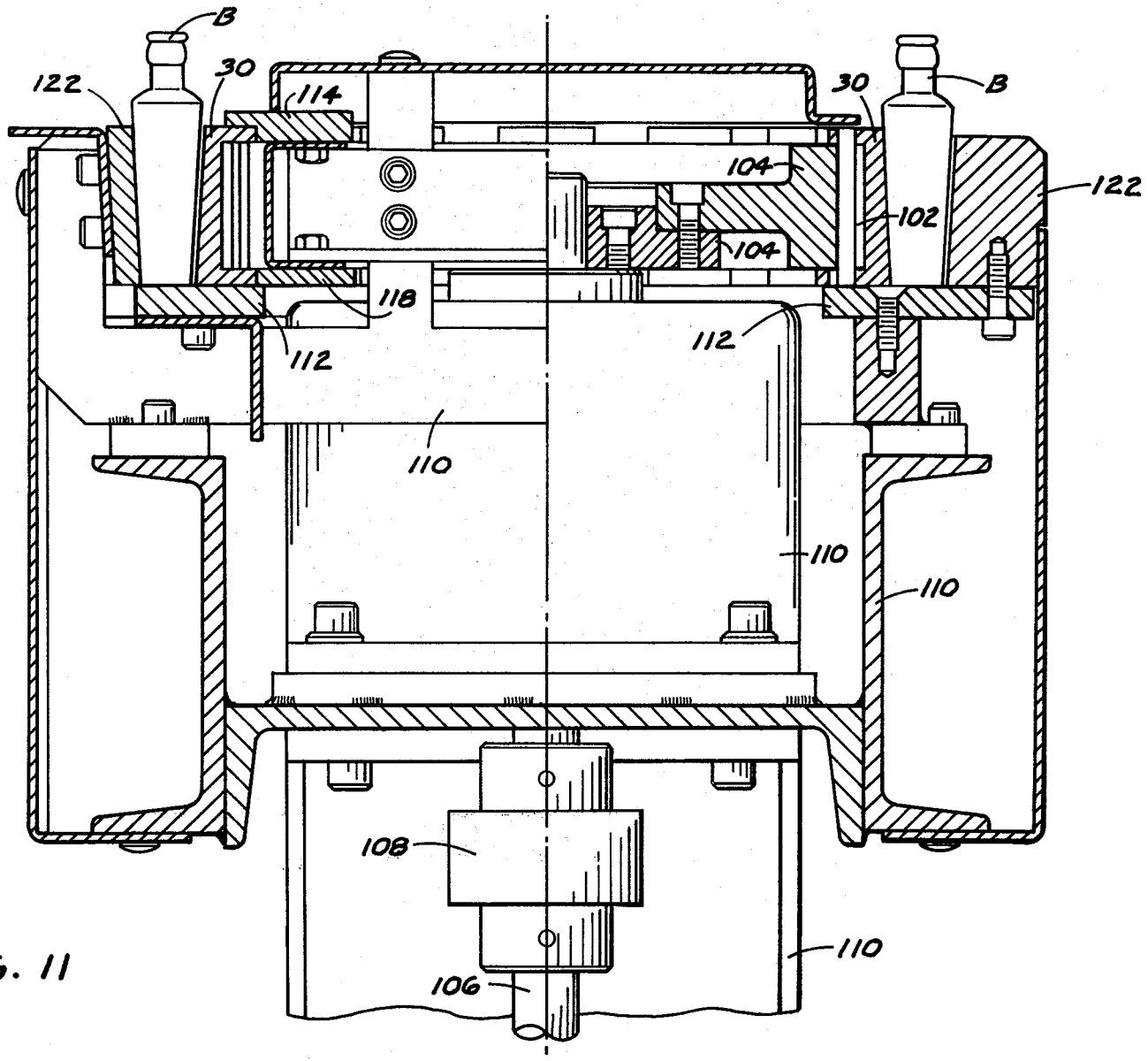
FIG. 11 is a vertical sectional view taken substantially on line 11—11 of FIG. 1.

FIG. 6, at its left, shows the conveyor 32 from about the same aspect as FIG. 11, but on a smaller scale, as the purpose of the left half of FIG. 6 is to show how the transfer device 36 transfers four bottles at a time from four respective cells 30 of the conveyor 32 to a row of four cells 38 at the transfer-to station 34 of the rotary indexing table 40. (This is also shown, but in less detail, in FIGS. 1 and 2.)

To avoid confusion of detail, only the transfer-to station 34 and the optical check inspection station 44 that are cut by the vertical plane on which FIG. 6 is taken are shown in this Figure. The plug gauging station is in front of that cutting plane and thus not shown in this Figure. The transfer-from station 46, strictly speaking, should appear centrally at the rear, but has been omitted. (It does show in FIGS. 1 and 2.)

The transfer device 36 is of a sort which has previously found use in analogous contexts. Basically, it includes a rotary drive train 124 to gear boxes 126 which provide shafts 128, 130 with reversing rotation, e.g. through somewhat more than half a revolution clockwise then through the same arc in reverse. Four sets of upper and lower transfer arms 132, 134 (e.g., two arms to a set) are secured at respective one ends to the respective shafts 128, 130 so the sets are spaced axially along the shaft. The distal ends of the arm sets are pivotally joined by respective link 136 to provide four parallelogram linkages 128–136. A downwardly addressing set of opposed tongs 138 is mounted on each link 136. The tongs 138 are pivotally mounted to grasp and release. As the four sets of transfer arms 132, 134 arc towards four bottle-filled cells 30 of the first indexing conveyor 32, the respective sets of tongs 138 are open. Upon contact, the four sets of tongs 138 grasp the necks of the four bottles B in the corresponding cells 30. Then the arms arc toward the transfer-to station 34, stuff the four bottles B in the four waiting cells 38 at the transfer-to station of the rotary indexing table 40 and release the bottles. The transfer arms begin to arc back for four more bottles as the conveyor 32 indexes four cells forwards and the rotary indexing table rotates through 90 degrees to bring four empty cells 38 to the transfer-to station and to move the just-filled cells 38 to the plug gauging station 42 (FIGS. 1 and 2).

The machine frame 140 includes a horizontal plate 142 having an opening 144. An indexing gear box 146 is secured to the plate 142 with its output shaft 148 projecting up through the opening 144.

The rotary indexing table 40 is shown having the form of a vertical axis drum with a lower plate 150 secured on the shaft 148, a tubular spacer 152 secured on the lower plate 150 and an upper plate 154 secured on the tubular spacer 152.

The rotary indexing table 40 is shown provided with sixteen upwardly opening cells 38 arranged in four rows of four in a square array (FIG. 1) centered upon the longitudinal axis of the rotary table 40.

Each cell 38 is mounted on the upper end of a respective spindle 156 that is journalled at 158, 160 in the plates 150, 154, for rotation about its own longitudinal axis. Accordingly, each cell 38 may be rotated through 360 degrees about its own vertical, longitudinal axis.

Between the plates 150 and 154 a friction wheel 156' is keyed onto each spindle 156' at a common level.

An alignment dog 160' is resiliently mounted on the machine frame 140 via a spring 162 and housing 164. The projecting nose 166 of the dog 160 is flat. When the rotary table 40 is indexed a quarter rotation, it comes to rest with the desired alignment of the four cells 38 at each station with the aid of the flat nose 166 simultaneously resiliently engaging four of the friction wheels 156' of one respective row of four cells 38. (In the instance depicted, the dog 160 underlies the transfer-to station 34. Of course if the cells are aligned at this station, the twelve other cells 38 are aligned at the three other stations also.)

Each cell 38 is shown including an upwardly open outer cup 168 and an inner cup 170 received therein as an adapter for the particular shape and size of bottle being inspected.

At the plug gauging station (FIG. 1), conventional plug gauging apparatus (not shown in detail) is used to determine whether the part of each bottle that will receive a closure has an acceptable size and shape. In general, four or more air cylinder-operated plugs are moved into engagement with the appropriate parts of each bottle. For instance, an inner plug enters the bottle neck and an outer capping plug surrounds the neck. The length of stroke of each air cylinder is monitored very precisely. If any cylinder must move its plug too far or not far enough before contact is made with the respective part of the respective bottle, a micro switch signals the electronic control unit (FIG. 19) that the respective bottle does not have the required dimensions and this fact is stored for use in later rejecting the respective bottle.

Meanwhile, the four bottles at the optical check inspection station 44 depicted at the right in FIG. 6 are each being mechanically rotated and photo-optionally inspected for flaws in the finish or top of the bottle, flaws in its shoulder, in its closure-securement means such as threading, and any other like features.

In FIG. 6, the apparatus for rotating and optically checking one bottle is illustrated as an example of the four.

At the optical check inspection station 44, the friction wheel 156' becomes drivingly engaged with a friction wheel 172 on a vertical shaft 174 journalled on the frame at 176. A worm wheel 178 secured on the shaft 174 is in driving engagment with a worm gear 180 secured on a shaft 182. Rotary power from the drive shaft 182 is supplied to the worm gear 180 via pulleys 184 and which have an endless drive belt entrained about them. Like rotational means 172-178 are driven from the worm gear 180 for the other spindles 158 at this station.

In FIG. 6, means for performing a simple electro-optical check on the bottle are depicted. Plural and more elaborate checking, including moving checking devices could be performed. However, since the inspecting devices are not new per se for the present invention, the illustration is believed to suffice. What is depicted is a standard or bridge 186 secured on the machine frame. The bridge 186 bears a light source 188 mounted by a clamping device 190 to the bridge 186 and is focused e.g. to illuminate a circumferential bead at the bottle mouth, and a photoelectric detector 192 mounted by a clamping device 194 to the bridge 186 and focused to collect light reflected at an angle $\theta$ from the bead. The detector 192 is, e.g., a phototransistor pickup connected via the line 196 to the control circuitry (FIG. 19). Other checking devices could be used. As each bottle B is rotated in this station, the detector 192 should detect a uniform or uniformly varying signal which can be compared in the circuitry of FIG. 19, for conformity. Lack of conformity with what should be detected indicates a flawed bottle, and that fact, for any respective bottle is stored in the control unit of FIG. 19 for use in later rejecting the respective bottle.

Also meanwhile, the four bottles at the transfer-from station 46 (FIGS. 1 and 2) are transferred from the four respective cells 38 to four transversally aligned cells 50 of the second indexing conveyor 52 by a second transfer device 48 which is constructed and operated like the first transfer device 36 (discussed above with reference to FIG. 6). Then the second indexing endless conveyor 52 is indexed four cells forwards to bring four empty cells 50 beside the transfer-from station 46. (After the turntable 40 has indexed another 90 degrees, to bring the bottles now at the optical check inspecting station to the transfer-from station, the transferring from process just described will be repeated for those bottles.)

The second indexing endless conveyor 52 (FIG. 1) is substantially similar in construction and operation to the first indexing endless conveyor 32 (discussed above with reference to FIGS. 1, 2, 6 and 11), except that a reject area 198 is provided for the second indexing endless conveyor where what amounts to the floor of the cells 52 is provided with what amounts to a trap door selectively operable at just the right moment by the control system of FIG. 19, to drop down through the second indexing endless conveyor any bottle found at the plug gauging station 42 and/or the optical check inspecting station 44 to be defective.

The construction and operation of the rejection station 198 will now be described in more detail with reference to FIGS. 7–10. (Like, but primed numbering is used to indicate parts here corresponding to those of the first indexing conveyor 32.)

As the conveyor 52 indexes each cell 50 in succession is brought to a site where its floor is constituted by a reject slide 202 mounted in opposed grooves 204 for horizontal sliding between a first position (FIG. 9) in which the respective bottle is supported thereby, and a second, retracted position (FIG. 10) in which there is an opening 206 where the floor had been and the respective bottle B, being unsupported, falls down therethrough.

The reject slide 202 is operated by an extensible-retractable air cylinder 208, in turn operated by signals from the control system (FIG. 19). Upon a moment's reflection, it will be seen that there is a fixed number of bottle positions between where a bottle defect may be discovered at stations 42 or 44 on the rotary indexing table 40 and the reject slide 202. Accordingly, the cylinder 208 is controlled by the system of FIG. 19 to pull the slide 202 to drop the respective bottle after that bottle has traveled that fixed number of bottle positions due to transferral and indexing. For instance, the system of FIG. 19 may, in effect, store a command, "The bottle now in the second cell of the plug gauging station has just been found to be defective. When the second indexing conveyor has indexed forwards twelve units, that bottle will overlie the slide 202, whereupon the air cylinder will retract the slide 202 to drop that bottle, then extend to replace the slide before the second indexing conveyor indexes another unit forwards."

The rejected bottle B (FIG. 10) dropping down through the opening 206 bounces off a plate 210 obliquely mounted on the machine frame by a bracket 212. This brakes the fall of the rejected bottle and lays it over on a cullet conveyor belt 54 whose upper run 214 extends transversally, horizontally outwards (FIG. 1) just below the plate 210 (FIG. 10).

When a bottle B not found to be defective is conveyed to the site where the respective cell 50 in which it is being conveyed overlies the reject slide 202, the slide merely remains in place and the next indexes carry that bottle further along the run of the second indexing endless conveyor 52 until that passed bottle and its passed bottle neighbors are transversally aligned with the packing station 56 (FIG. 1).

Figure 8:
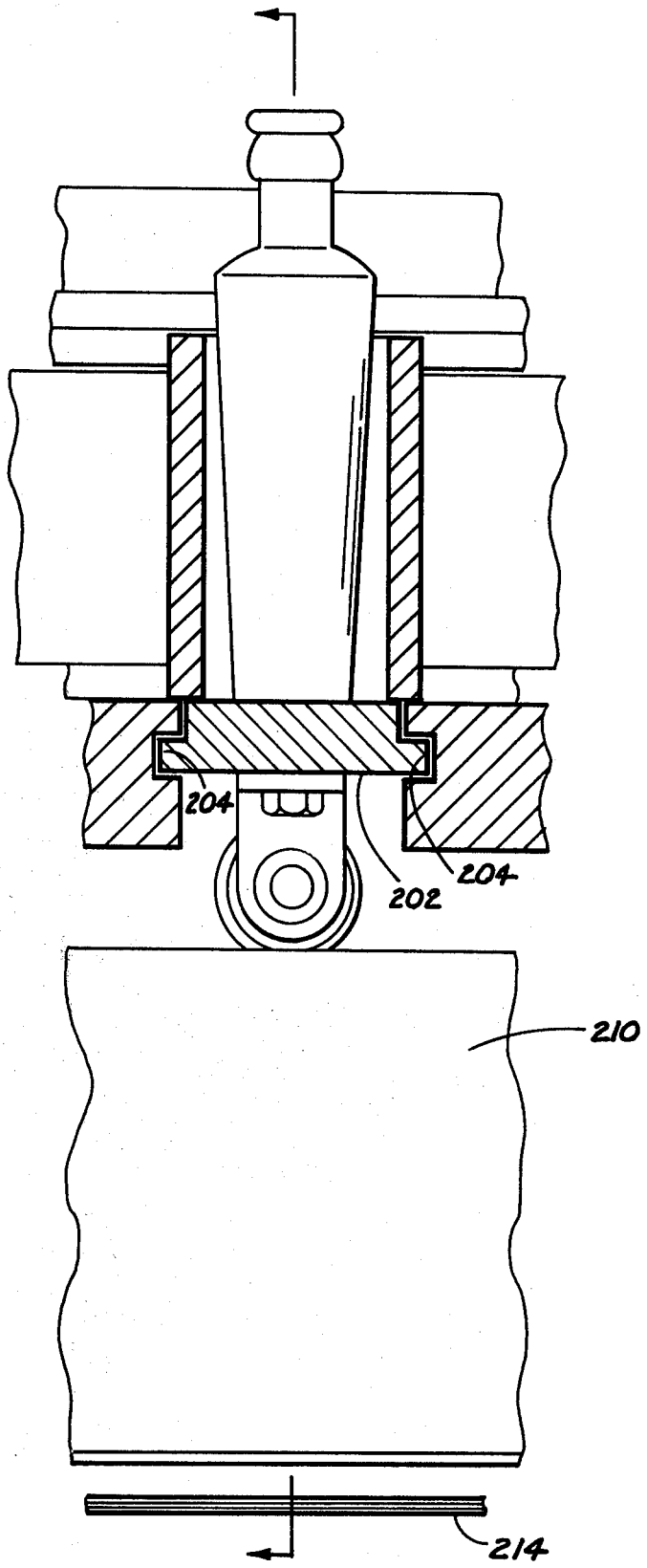
FIGS. 8, 9 and 10 are fragmentary vertical sectional views of successive steps of bottle rejection at the rejection station.
Figure 9:
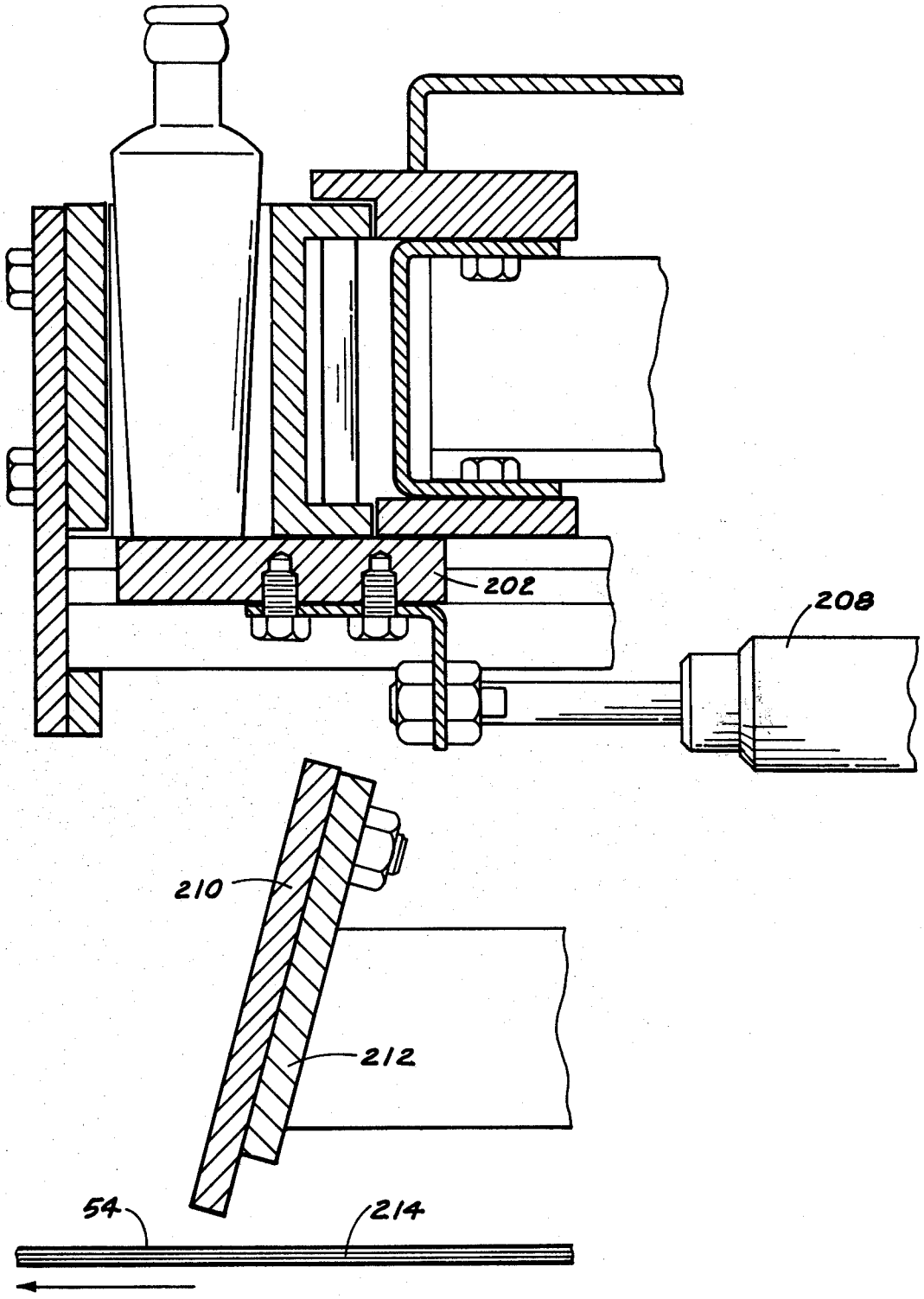
Figure 10:
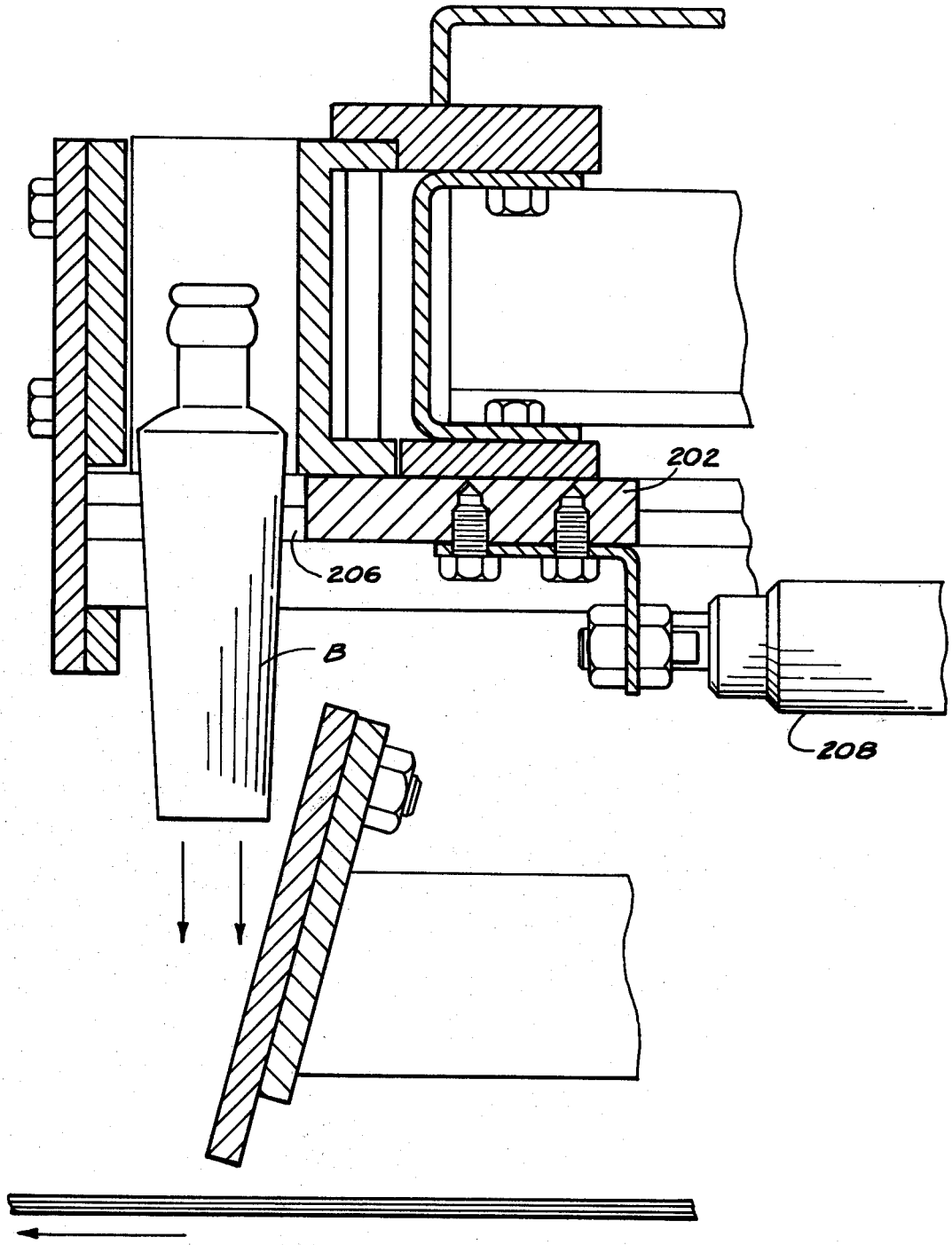

At the packing station 56, a plurality, for instance eleven, contiguous sites 216, the cells 50 are bottomed by air cylinder-operated slide means (not shown in detail, but like the slide 202 of FIGS. 8–10). Each time the second indexing conveyor 52 has indexed forwards a like plurality of units, for instance eleven, that slide means is briefly retracted to permit the passed bottles to fall down through the conveyor 52 onto a second orienting table 218. Although it is shown more schematically in FIG. 1, the second orienting table 218 is constructed like and is operated like the first orienting table 18. (In the variation shown in FIG. 20, the second indexing endless conveyor 52 is omitted. Instead, the second transfer device 48 directly serves a four cell rejection station 220 positioned over the cullet conveyor 54 at the upstream end of the second orientation table 218. Rejected bottles are permitted to fall through to the cullet conveyor 54 by retracting a slide as described above, and passed bottles are laid over onto the second orientation table 218.)

The downstream end of the second orientation table 218 is shown at the upper right in each of FIGS. 12–18. The packing operation will now be described in more detail with reference to these Figures.

The second orientation table 218 is constructed, operated and served like the first orientation table except that its associated escapement devices, in the preferred embodiment, include anti-bounce pads 100' instead of slides 100. The parts which are comparable are similarly numbered, but primed.

The initially generally randomly oriented bottles on the table 218 are laid over, vibrated and brushed into lanes 22'. The lanes 22' are only slightly wider than the bottles, so each bottle to enter a lane 22' becomes longitudinally aligned with those ahead in the same lane, horizontal and having its neck presented either forwards or rearwards.

A row of escapement devices 28' is provided to extend transversally of the lanes 22' at the downstream ends thereof, one escapement device 28' for each lane 22'.

FIGS. 12–18 are fragmentary longitudinal vertical sectional views. In them only one lane's-worth of bottles is shown. The same thing as is shown in these views is also happening substantially simultaneously with each of the other lanes'-worth of bottles across the width of the packing station.

The packing station 56 further includes an endless belt 230 (FIGS. 1, 12–18 and 20) with a horizontal upper run 232 traveling outwardly in the direction parallel to the longitudinal direction of the lanes 22'. Empty cartons C with bottoms 234 and upstanding sidewalls 236 and endwalls 238 are placed in close-packed, orthogonal columns and rows on the conveyor run 232 somewhat upstream of vertical registry with the row of escapement devices 28'. In terms of bottle receiving sites, each row of cartons C is as wide as will place a bottle receiving site under the escapement device 28' of each operating lane 22' each time the conveyor run 232 moves forwards by one unit.

The typical sequence of packing will now be further discussed with serial reference to FIGS. 12–18.

Figure 12:
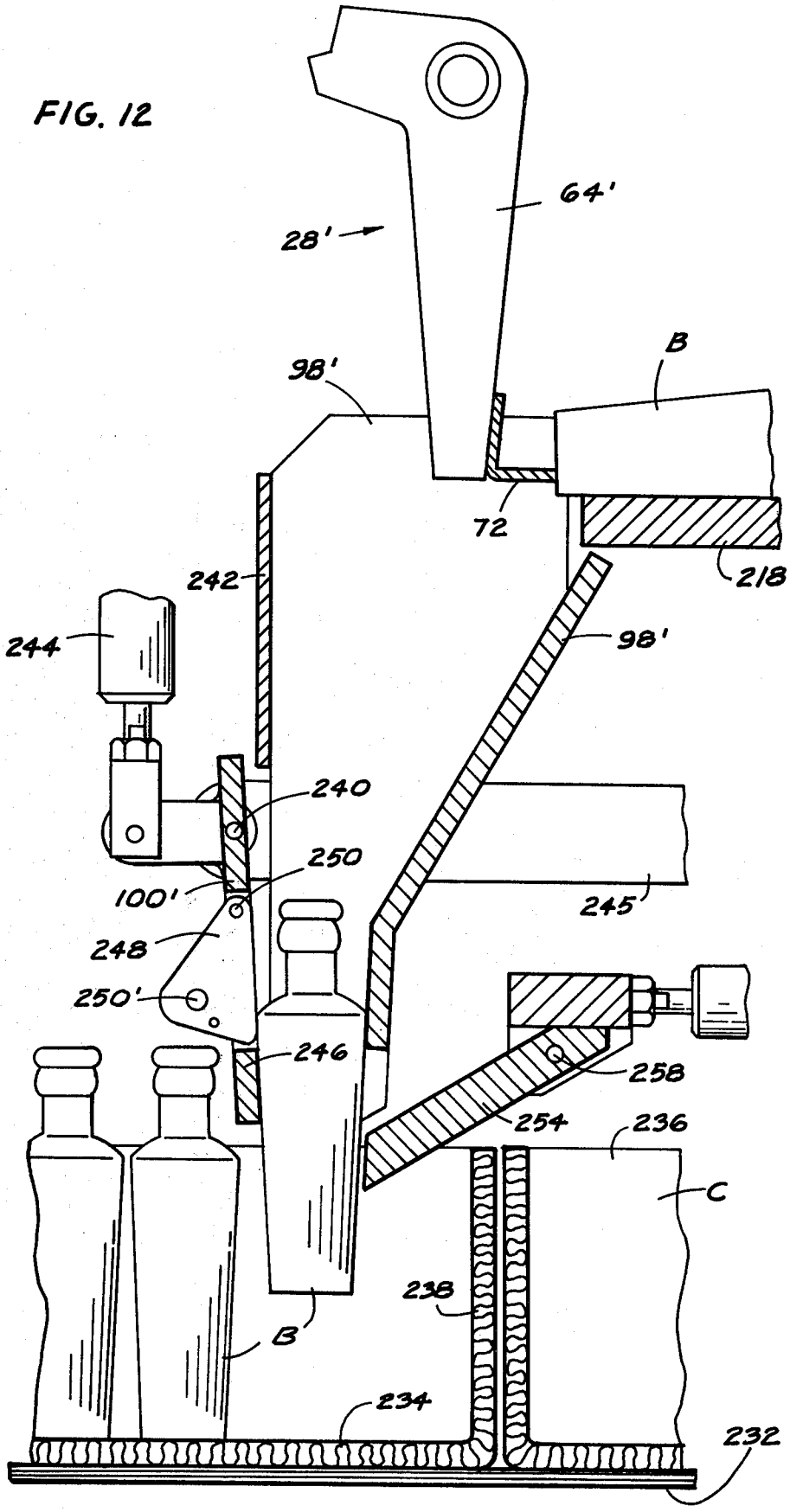

In FIG. 12, the anti-bounce pad 100' is seen to be pivotally mounted at 240 to provide a lower part of the foremost sidewall 242 of the chute 98'.

Figure 13:
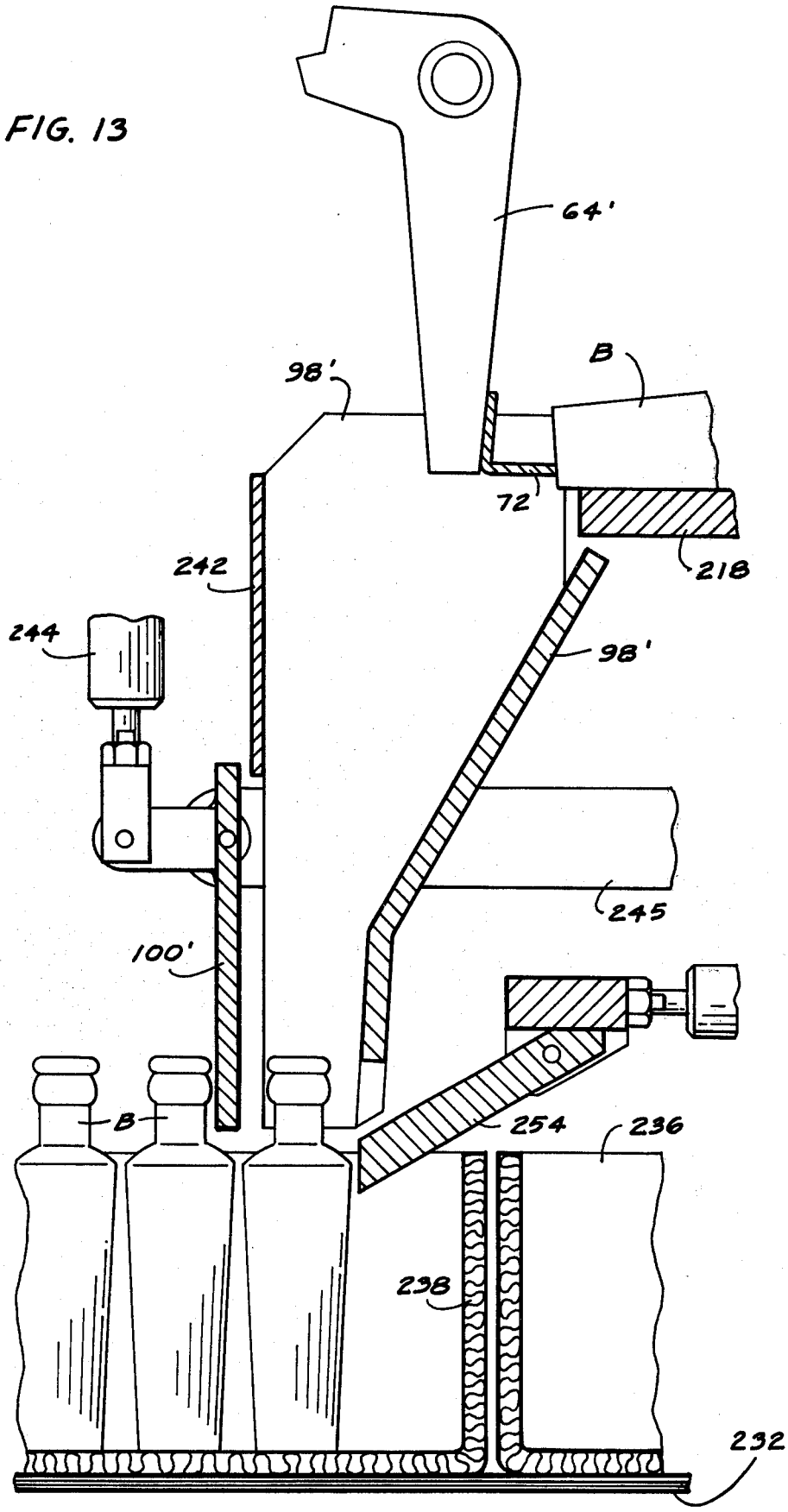
Figure 14:
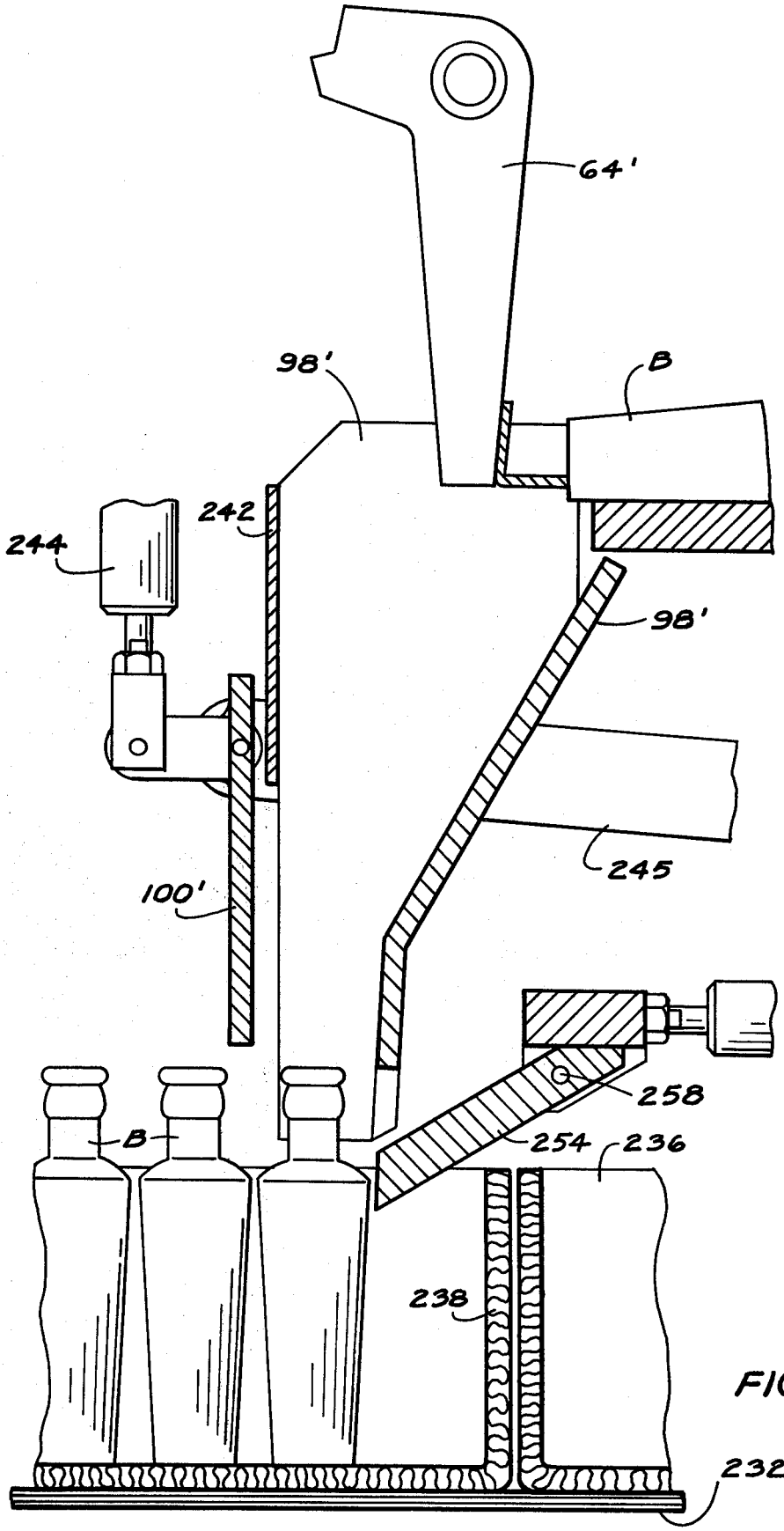
Figure 15:
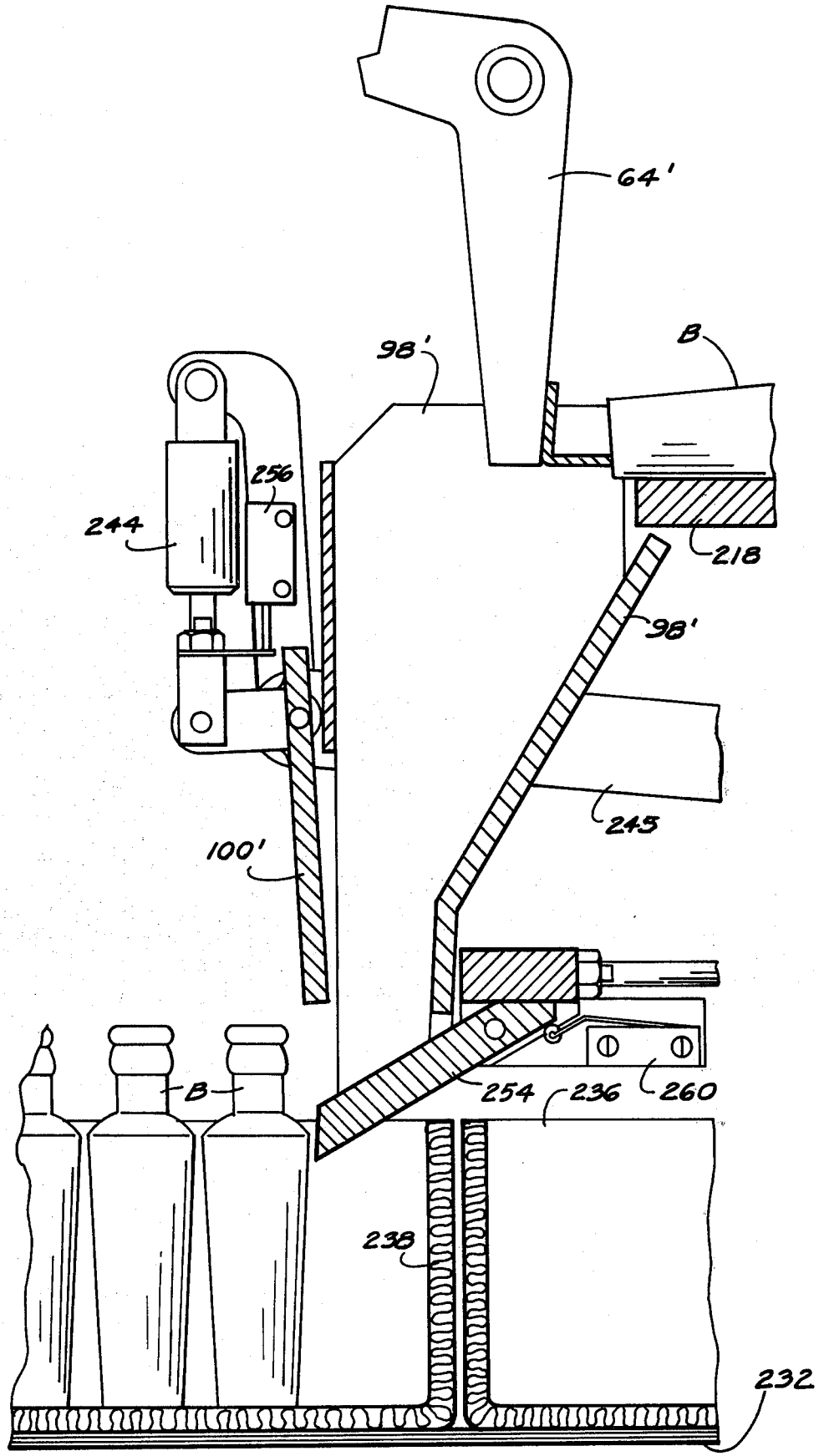

The pad 100' is arranged to be moved by slight extension and retraction of an air cylinder 244 between the position shown in FIG. 12, in which it so restricts the throat of the chute 98' that a bottle B will hang therein and the position shown in FIG. 13, in which the pad 100' has moved sufficiently to enlarge the throat enough to let the hung bottle complete its drop through the chute throat into the underlying carton C.

The pads 100' and air cylinder 244 are mounted on an arm 245 mounted for vertical movement on the machine frame.

Each anti-bounce pad 100' is provided with a slot 246 through its thickness. A mechanical feeler 248 is pivoted at 250 to swing through the slot and shaped to normally protrude into the throat of the chute 98'. Exteriorly of the throat, the feeler 248 has an opening 250' through the thickness thereof, transversally of the row of second escapement devices 28'. A lamp and photoelectric detector set 252 (FIG. 20) arranged across the row of devices 28' cues the controls of FIG. 19 to extend and retract the air cylinder 244 as follows. As each chute 98' receives a bottle, that bottle engages the respective mechanical feeler 248 and pivots it out of the throat sufficiently to align the opening 250' of that feeler with the light beam of the photoelectric detector set 252. For the chutes not yet containing bottles, the mechanical feelers 248 continue to obstruct the light beam. Finally, when each chute 98' contains a bottle the light beam can pass through all the openings 250 and reach the detector, whereupon the control system of FIG. 19 is signalled and in turn commands the air cylinder 244 to extend from its FIG. 12 position to its FIG. 13 position. That pivots the anti-bounce pads 100' sufficiently out of constricting relation to the throats of the chutes 98' to permit the bottles in all the chutes 98 to complete their descent through the respective throats and into the underlying carton.

It should now be noticed that a container movement guide and box detector in the form of a bottle follower arm 254 is shown in FIGS. 12–15 slanting down into the carton C just behind the bottle that is being dropped into the carton. There are as many of these as there are bottle positions or cartons across the width of the packing station. One function is to define with the row of bottles just previously dropped into place or with the carton end wall, a slot just wide enough for the row of bottles being dropped into place to be properly sited without falling over.

When the anti-bounce pad cylinder 244 retracts it makes a microswitch 256 (FIG. 15) which signals the control system (FIG. 19) to command the arm 245 to momentarily raise to lift the anti-bounce pads 100' over the row of bottles just dropped and the conveyor belt 230 to index forward by one bottle site. It also frees the escapement devices 28' to begin dropping bottles, one each bottom end down into the chutes 98'.

The bottle follower arm 254 has another function: when the conveyor 230 indexes forward to bring the last row of bottle-receiving sites of a carton under the chutes 98' (FIG. 15 to FIG. 16), the leading box trailing end wall and the next following box leading end wall constitute a hurdle for the bottle follower arm 254 which it pivots upwards to clear, it being pivotally mounted at 258. In so doing it makes a microswitch 260 which signals the fact of box wall contact to the control system of FIG. 19 so that the next time the conveyor 230 advances, it moves forward by one bottle site plus two carton end wall thicknesses (FIG. 16 to FIG. 17) to bring the succeeding row of bottle sites directly under the chutes 98'.

As mentioned above, the interaction of a bottle B addressing the escapement device container holding and orientation level 64' bottom first is shown in FIGS. 16–18. In contrast to the situation in FIGS. 3–5, in which the bottle neck rests on the ledge flange 72 until enough of the bottle is off the leading edge 96 of the support surface 18 that it drops bottom end down, when the bottle addresses the lever 64' bottom end forwards as in FIGS. 16–18, the bottle bottom engages but is not supported by the ledge flange 72, so, again, the bottle drops bottom end down (FIG. 18).

In the drawings, not all microswitches, photoelectric devices and the like are shown in all Figures. These switches and devices are conventional and are conventionally operated, so their further depiction would be surplusage.

Of course, the numbers of units each conveyor, transfer device, carton and the like is wide and/or long and the like in the embodiment shown and described is purely exemplary and may be considerably changed without sacrificing the principles set forth.

It should now be apparent that the cold end for glass container production line as described hereinabove, possesses each of the attributes set forth in the specification under the heading "Summary of the Invention" hereinbefore. Because the cold end for glass container production line can be modified to some extent without departing from the principles of the invention as they have been outlined and explained in this specification, the present invention should be understood as encompassing all such modifications as are within the spirit and scope of the following claims.

What is claimed is:

1. Apparatus for processing elongated, each two differing ended, like articles received in a random orientation, comprising:

(a) means for arranging the articles in a plurality of transversally adjacent longitudinally extending horizontal, separate columns, each consisting of a single series of the articles in a longitudinally aligned, laid down, either end forwards orientation;

(b) an angularly indexing rotary table having at least three stations thereabout, including a transfer-to station, an article processing station, and a transfer-from station;

(c) means providing a plurality of article accepting cells thereon for each station, these cells being so distributed about the rotary table that there are a plurality of said cells at each said station at the conclusion of each indexing of the rotary table;

(d) means for repeatingly simultaneously abstracting the foremost article from each of a plurality of said columns, and for orienting and serially transferring the articles so abstracted, one each, upright, same end down, into said article accepting cells then at the transfer-to station of the rotary table;

(e) means for simultaneously interacting with and thus processing the article in each of said plurality of cells upon rotation of that plurality of cells to the article processing station; and (f) means for repeatingly simultaneously abstracting the articles from the respective cells upon rotation of the cells to the transfer-from station and for simultaneously depositing these abstracted articles distally of the rotary table.

2. The apparatus of claim 1, wherein:

the articles are bottles having necks with mouths, and the means for interacting with and thus processing the bottles at the article processing station are constituted by respective means for simultaneously plug gauging the neck and mouth of each bottle at the article processing station.

3. The apparatus of claim 2, wherein:

the plug gauging means includes means for comparing the size and shape of each bottle neck and mouth with a standard, and means for recording which bottles meet distinctly from which bottles fail to meet the standard;

the means (f) includes two distinct ultimate depositing sites for the bottles abstracted from said cells, and means responsive to said recording means for shifting the means (f) depositing the abstracted bottles at these two sites, in dependence upon whether the bottles being deposited have been recorded as have met or failed to meet said standard.

4. The apparatus of claim 1, wherein:

the articles are bottles having necks with mouths, and the means for interacting with and thus processing the bottles at the article processing station are constituted by respective means for simultaneously examining at least one uniformly located site on each bottle at the article processing station, means for comparing the results of that examination with a standard, and means for recording which bottles meet distinctly from which bottles fail to meet that standard;

the means (f) includes two distinct ultimate depositing sites for the bottles abstracted from said cells, and means responsive to said recording means for shifting the means (f) depositing the abstracted bottles at these two sites, in dependence upon whether the bottles being deposited have been recorded as have met or failed to meet said standard.

5. The apparatus of claim 4, wherein:

the at least one uniformly located site on each bottle is a circumferential band thereon; and the rotary table further includes means for simultaneously rotating each cell while at the article processing station through at least one complete revolution relative to the respective examining means, in order to present all of said bands thereto for examination.

6. The apparatus of claim 5, wherein:

the bottles are of like non-circular transverse cross-sectional shape; and each cell comprises an upwardly open outer cup that is considerably larger in transverse cross-sectional shape than each bottle, and an upwardly open inner cup securely received in the outer cup and having an internal, upwardly open socket of a transverse cross-sectional shape that is sized and shaped to fittingly receive a respective said bottle.

7. The apparatus of claim 6, wherein:

the means (f) includes an indexing conveyor with a floor including a trap door; means for serially, momentarily disposing each bottle at the site of the trap door; and for opening the trap door only when the bottle then disposed thereover is one recorded as having failed to meet said standard.

8. The apparatus of claim 6, wherein:

the means (a) is constituted by:

an orientation table having an upwardly presented support surface with a first, upstream end proximate a conveyor and a second, opposite, downstream end distally thereof in a longitudinal direction;

divider means disposed upon the orientation table and dividing said support surface into a plurality of transversally adjacent, longitudinally extending lanes leading from intermediate said ends of the orientation table, to said downstream end thereof, each lane being only slightly wider than each article and substantially narrower than each article is long;

means associated with said support surface for contacting the articles transferring from said conveyor onto said support surface and moving the articles into said lanes in a horizontally elongated, either end forwards orientation;

an endless, indexing conveyor being arranged having a first run transversally of and below the downstream end of the orientation table;

said endless, indexing conveyor having means providing a series of upwardly open cells, each cell being arranged and configured to receive a said article from above, the cells and lanes being on centers spaced substantially equally as far apart, so that the cells and lanes may be brought into one to one correspondence and vertical registry in said first run;

an escapement device associated with each lane at the downstream end of the orientation table for periodically encountering the leading article in each lane, regardless of whether that artciel is oriented with one of its ends forwards or with the other of its ends forwards and depositing that article, upright with its one end downwards in the respective underlying cell of said endless, indexing conveyor;

said endless, indexing conveyor also being arranged having a second run further therealong than said first run, beyond the orientation table;

a transfer device having arm means with an article gripper means, movable between a first position wherein the gripper means is disposed to grip each article disposed one end down in said at least one cell of the second run of the endless, indexing conveyor that is transversally aligned with a corresponding said at least one cell of the rotary table of said transfer-to station thereof, and to move each respective article so gripped, to a second position wherein each respective article is disposed said one end down in a respective one of said plurality of cells of the rotary table then at the transfer-to station thereof, and for releasing each gripped article when said second position is reached.

9. Apparatus for processing elongated, each two differing ended, like articles received in a random orientation, comprising:

(a) means for arranging the articles in a plurality of transversally adjacent longitudinally extending horizontal, separate columns, each consisting of a single series of the articles in a longitudinally aligned, laid down, either end forwards orientation;

(b) an angularly indexing rotary table having at least three stations thereabout, including a transfer-to station, an article processing station, and a transfer-from station;

(c) means providing at least one article accepting cell thereon for each station, these cells being so distributed about the rotary table that there is at least one said cell at each said station at the conclusion of each indexing of the rotary table;

(d) means for repeatingly abstracting the foremost article from each column, and for orienting and serially transferring the articles so abstracted, one each, upright, same end down, into said at least one article accepting cell then at the transfer-to station of the rotary table;

(e) means for interacting with and thus processing the article in each cell upon rotation of that cell to the article processing station; and (f) means for repeatingly abstracting the articles from the respective cells upon rotation of the cells to the transfer-from station and for depositing these abstracted articles distally of the rotary table;

the articles being bottles having necks with mouths, and the means for interacting with and thus processing the bottles at the article processing station being constituted by means for examining at least one uniformly located site on each bottle, means for comparing the results of that examination with a standard, and means for recording which bottles meet distinctly from which bottles fail to meet that standard;

the means (f) including two distinct ultimate depositing sites for the bottles abstracted from said cells, and means responsive to said recording means for shifting the means (f) depositing the abstracted bottles at these two sites, in dependence upon whether the bottles being deposited have been recorded as have met or failed to meet said standard;

the at least one uniformly located site on each bottle being a circumferential bank thereon; and the rotary table further including means for rotating each cell while at the article processing station through at least one complete revolution relative to the examining means, in order to present all of said band thereto for examination;

the bottles being of like non-circular transverse cross-sectional shape; and each cell comprising an upwardly open outer cup that is considerably larger in transverse cross-sectional shape than each bottle, and an upwardly open inner cup securely received in the outer cup and having an internal, upwardly open socket of a transverse cross-sectional shape that is sized and shaped to fittingly receive a respective said bottle.

10. The apparatus of claim 9, wherein:

the means (f) includes an indexing conveyor with a floor including a trap door; means for serially, momentarily disposing each bottle at the site of the trap door; and for opening the trap door only when the bottle then disposed thereover is one recorded as having failed to meet said standard.

11. The apparatus of claim 9, wherein:

the means (a) is constituted by:

an orientation table having an upwardly presented support surface with a first, upstream end proximate a conveyor and a second, opposite, downstream end distally thereof in a longitudinal direction;

divider means disposed upon the orientation table and dividing said support surface into a plurality of transversally adjacent, longitudinally extending lanes leading from intermediate said ends of the orientation table, to said downstream end thereof, each lane being only slightly wider than each article and substantially narrower than each article is long;

means associated with said support surface for contacting the articles transferring from said conveyor onto said support surface and moving the articles into said lanes in a horizontally elongated, either end forwards orientation;

an endless, indexing conveyor being arranged having a first run transversally of and below the downstream end of the orientation table;

said endless, indexing conveyor having means providing a series of upwardly open cells, each cell being arranged and configured to receive a said article from above, the cells and lanes being on centers spaced substantially equally as far apart, so that the cells and lanes may be brought into one to one correspondence and vertical registry in said first run;

an escapement device associated with each lane at the downstream end of the orientation table for periodically encountering the leading article in each lane, regardless of whether that article is oriented with one of its ends forwards or with the other of its ends forwards and depositing that article, upright with its one end downwards in the respective underlying cell of said endless, indexing conveyor;

said endless, indexing conveyor also being arranged having a second run further therealong than said first run, beyond the orientation table;

a transfer device having arm means with an article gripper means, movable between a first position wherein the gripper means is disposed to grip each article disposed one end down in said at least one cell of the second run of the endless, indexing conveyor that is transversally aligned with a corresponding said at least one cell of the rotary table of said transfer-to station thereof, and to move each respective article so gripped, to a second position wherein each respective article is disposed said one end down in a respective cell of the rotary table at the transfer-to station thereof, and for releasing each gripped article when said second position is reached.

12. The apparatus of claim 9, wherein:

the means for interacting with and thus processing the bottles at the article processing station is further constituted by means for plug gauging the neck and mouth of each bottle.

13. The apparatus of claim 12, wherein:

the plug gauging means includes means for comparing the size and shape of each bottle neck and mouth with a second standard, and means for recording which bottles meet distinctly from which bottles fail to meet the second standard;

the means (f) includes means responsive to said recording means for shifting the means (f) depositing the abstracted bottles at said two sites, in dependence upon whether the bottles being deposited have been recorded as have met or failed to meet said second standard.

14. Apparatus for processing elongated, each two differing ended, like articles received on a conveyor in random orientation, comprising:

an orientation table having an upwardly presented support surface with a first, upstream end proximate said conveyor and a second, opposite, downstream end distally thereof in a longitudinal direction;

divider means disposed upon the orientation table and dividing said support surface into a plurality of transversally adjacent, longitudinally extending lanes leading from intermediate said ends of the orientation table, to said downstream end thereof, each lane being only slightly wider than each article and substantially narrower than each article is long;

means associated with said support surface for contacting the articles transferring from said conveyor onto said support surface and moving the articles into said lanes in a horizontally elongated, either end forwards orientation;

an endless, indexing conveyor being arranged having a first run transversally of and below the downstream end of the orientation table;

said endless, indexing conveyor having means providing a series of upwardly open cells, each cell being arranged and configured to receive a said article from above, the cells and lanes being on centers spaced substantially equally as far apart, so that the cells and lanes may be brought into one to one correspondence and vertical registry in said first run;

an escapement device associated with each lane at the downstream end of the orientation table for periodically encountering the leading article in each lane, regardless of whether that article is oriented with one of its ends forwards or with the other of its ends forwards and depositing that article, upright with its one end downwards in the respective underlying cell of said endless, indexing conveyor;

said endless, indexing conveyor also being arranged having a second run further therealong than said first run, beyond the orientation table;

an indexing, multi-station rotary table juxtaposed beside the second run of said endless, indexing conveyor and having a transfer-to station, at least one article processing station and a transfer-from station angularly spaced fron one another thereabout;

said rotary table having means providing at least one upwardly open cell at each said station thereof, each cell being arranged and configured to receive a said article from above;

means for periodically rotationally indexing said rotary table to transversally align the at least one cell of the rotationally upstream station thereof with a corresponding at least one cell of said second run of the endless, indexing conveyor at said transfer-to station;

a transfer device having arm means with an article gripper means, movable between a first position wherein the gripper means is disposed to grip each article disposed one end down in said at least one cell of the second run of the endless, indexing conveyor that is transversally aligned with a corresponding said at least one cell of the rotary table of said transfer-to station thereof, and to move each respective article so gripped, to a second position wherein each respective article is disposed said one end down in a respective cell of the rotary table at the transfer-to station thereof, and for releasing each gripped article when said second position is reached;

means juxtaposed adjacent the rotary table at said at least one processing station for confronting each article disposed in a said cell of the rotary table when brought to said at least one processing station through rotation of said rotary table, and for interacting with each article so confronted, for instance to obtain information therefrom; and a second transfer device having arm means with an article gripper means, movable between a first position wherein the gripper means is disposed to grip each article disposed one end down in said at least one cell of the rotary table at the transfer-from station, and to move each respective article so gripped, to a second position distally of the rotary table and for releasing each gripped article when said second position of said second transfer device is reached;

each escapement device comprising:

a chute extending downwards from just downstream of the leading end of the orientation table to just above a respective cell of the endless, indexing conveyor; a pivotally mounted article holding and orientation lever; means for releasably locking said lever in position to be engageed by the leading article in the respective lane to prevent that article from being moved forwardly across the leading end of the orientation table and down the respective chute; said lever having ledge means positioned to support said other end of the leading article until the one end of that leading article has crossed the leading edge of the orientation table if said other end is presented forwards toward said lever, and to fail to support the one end of the leading article if said one end is presented forwards toward said lever, so that said leading article drops down said chute into the respective cell with said one end of said article presented downwards;

said apparatus further comprising:

a slide means for each chute reciprocably mounted to move between a first position wherein it sufficiently blocks the respective chute to interrupt the article dropping in said chute from completing its drop into the respective cell, and a second position wherein the slide is sufficiently withdrawn to let the interrupted article complete its drop;

means for indicating when each respective chute contains an interupped article;

means for sensing when such an indication is provided in respect of all the chutes and for then momentarily moving siad slide means from said first position thereof to said second position thereof to simultaneously permit all the articles to complete their respective drops into the respective cells; and means responsive to the interaction of each lever with a leading article in dropping that article into a respective chute and responsive to the return of said slide means to said first position, to release said releasably locking means for each locking level only when the slide means has returned to said first position and the respective chute does not already contain an interrupted article.

15. The apparatus of claim 14, wherein:

the articles are bottles having necks with mouths, and the means for confronting and interacting with each bottle at the bottle processing station of the rotary table is constituted by means for plug gauging the neck and mouth of each bottle.

16. The apparatus of claim 15, wherein:

the plug gauging means includes means for comparing the size and shape of each bottle neck and mouth with a standard, and means for recording which bottles meet distinctly from which bottles fail to meet the standard;

said second position of said second transfer device including two distinct ultimate depositing sites for the bottles abstracted from said cells, and means responsive to recording means for shifting means for depositing the abstracted bottles at these two sites, in dependence upon whether the bottles being deposited have been recorded as have met or failed to meet said standard.

17. Apparatus for processing elongated, each two differing ended, like articles received on a conveyor in random orientation, comprising:

an orientation table having an upwardly presented support surface with a first, upstream end proximate said conveyor and a second, opposite, downstream end distally thereof in a longitudinal direction;

divider means disposed upon the orientation table and dividing said support surface into a plurality of transversally adjacent, longitudinally extending lanes leading from intermediate said ends of the orientation table, to said downstream end thereof, each lane being only slightly wider than each article and substantially narrower than each article is long;

means associated with said support surface for contacting the articles transferring from said conveyor onto said support surface and moving the articles into said lanes in a horizontally elongated, either end forwards orientation;

an endless, indexing conveyor being arranged having a first run transversally of and below the downstream end of the orientation table;

said endless, indexing conveyor having means providing a series of upwardly open cells, each cell being arranged and configured to receive a said article from above, the cells and lanes being on centers spaced substantially equally as far apart, so that the cells and lanes may be brought into one to one correspondence and vertical registry in said first run;

an escapement device associated with each lane at the downstream end of the orientation table for periodically encountering the leading article in each lane, regardless of whether that article is oriented with one of its ends forwards or with the other of its ends forwards and depositing that article, upright with its one end downwards in the respective underlying cell of said endless, indexing conveyor;

said endless, indexing conveyor also being arranged having a second run further therealong than said first run, beyond the orientation table;

an indexing, multi-station rotary table juxtaposed beside the second run of said endless, indexing conveyor and having a transfer-to-station, at least one article processing station and a transfer-from station angularly spaced from one another thereabout;

said rotary table having means providing at least one upwardly open cell at each said station thereof, each cell being arranged and configured to receive a said article from above;

means for periodically rotationally indexing said rotary table to transversally align the at least one cell of the rotationally upstream station thereof with a corresponding at least one cell of said second run of the endless, indexing conveyor at said transfer-to station;

a transfer device having arm means with an article gripper means, movable between a first position wherein the gripper means is disposed to grip each article disposed one end down in said at least one cell of the second run of the endless, indexing conveyor that is transversally aligned with a corresponding said at least one cell of the rotary table of said transfer-to station thereof, and to move each respective article so gripped, to a second position wherein each respective article is disposed said one end down in a respective cell of the rotary table at the transfer-to station thereof, and for releasing each gripped article when said second position is reached;

means juxtaposed adjacent the rotary table at said at least one processing station for confronting each article disposed in a said cell of the rotary table when brought to said at least one processing station through rotation of said rotary table, and for interacting with each article so confronted, for instance to obtain information thereof; and a second transfer device having arm means with an article gripper means, movable between a first position wherein the gripper means is disposed to grip each article disposed one end down in said at least one cell of the rotary table at the transfer-from station, and to move each respective article so gripped, to a second position distally of the rotary table and for releasing each gripped article when said second position of said second transfer device is reached;

each escapement device comprising:

a chute extending downwards from just downstream of the leading end of the orientation table to just above a respective cell of the endless, indexing conveyor; a pivotally mounted article holding and orientation lever; means for releasably locking said lever in position to be engaged by the leading article in the respective lanes to prevent that article from being moved forwardly across the leading end of the orientation table and down the respective chute; said lever having ledge means positioned to support said other end of the leading article until the one end of that leading article has crossed the leading edge of the orientation table if said other end is presented forwards toward said lever, and to fail to support the one end of the leading article if said one end is presented forwards toward said lever, so that said leading article drops down said chute into the respective cell with said one end of said article presented downwards;

the articles being bottles having necks with mouths, and the means for confronting and interacting with each bottle at the bottle processing station of the rotary table being constituted by means for examining at least one uniformly located site on each bottle, means for comparing the results of that examination with a standard, and means for recording which bottles meet distinctly from which bottles fail to meet that standard;

an indexing conveyor disposed at said second position of said second tranfer device distally of the rotary table, ready to receive each released bottle, said indexing conveyor having a floor including a trap door; means for serially, momentarily disposing each bottle at the site of the trap door; and for opening the trap door only when the bottle then disposed thereover is one recorded as having failed to meet said standard, whereby the bottles which have met the standard are separated from those which have failed to meet said standard.

18. The apparatus of claim 17, wherein:

the at least one uniformly located site on each bottle is a circumferential band thereon; and the rotary table further includes means for rotating each cell while at the article processing station through at least one complete revolution relative to the electronic examining means, in order to present all of said band thereto for examination.

19. The apparatus of claim 18, wherein:

the bottles are of like non-circular transverse cross-sectional shape; and each cell comprises an upwardly open outer cup that is considerably larger in transverse cross-sectional shape than each bottle, and an upwardly open inner cup securely received in the outer cup and having an internal, upwardly open socket of a transverse cross-sectional shape that is sized and shaped to fittingly receive a respective said bottle.

* * * * *